US006941913B2

(12) United States Patent
Smith

(10) Patent No.: US 6,941,913 B2
(45) Date of Patent: Sep. 13, 2005

(54) SPOOL VALVE CONTROLLED VCT LOCKING PIN RELEASE MECHANISM

(75) Inventor: Franklin R. Smith, Cortland, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 10/947,511

(22) Filed: Sep. 22, 2004

(65) Prior Publication Data

US 2005/0034695 A1 Feb. 17, 2005

Related U.S. Application Data

(63) Continuation-in-part of application No. 10/603,637, filed on Jun. 25, 2003, now Pat. No. 6,814,038.

(60) Provisional application No. 60/411,921, filed on Sep. 19, 2002.

(51) Int. Cl.[7] ..... F01L 1/34

(52) U.S. Cl. ..... 123/90.17; 123/90.16; 123/90.15; 123/90.31; 464/160

(58) Field of Search ..... 123/90.17; 464/160

(56) References Cited

U.S. PATENT DOCUMENTS

| | | | | |
|---|---|---|---|---|
| 5,002,023 | A | 3/1991 | Butterfield et al. | 123/90.17 |
| 5,107,804 | A | 4/1992 | Becker et al. | 123/90.17 |
| 5,172,659 | A | 12/1992 | Butterfield et al. | 123/90.17 |
| 5,184,578 | A | 2/1993 | Quinn, Jr. et al. | 123/90.17 |
| 5,289,805 | A | 3/1994 | Quinn, Jr. et al. | 123/90.17 |
| 5,361,735 | A | 11/1994 | Butterfield et al. | 123/90.17 |
| 5,386,807 | A | 2/1995 | Linder | 123/90.17 |
| 5,497,738 | A | 3/1996 | Siemon et al. | 123/90.17 |
| 5,657,725 | A | 8/1997 | Butterfield et al. | 123/90.17 |
| 5,901,674 | A | 5/1999 | Fujiwaki | 123/90.17 |
| 5,941,202 | A | 8/1999 | Jung | 123/90.17 |
| 6,247,434 | B1 | 6/2001 | Simpson et al. | 123/90.17 |
| 6,250,265 | B1 | 6/2001 | Simpson | 123/90.17 |
| 6,263,846 | B1 | 7/2001 | Simpson et al. | 123/90.17 |
| 6,311,655 | B1 | 11/2001 | Simpson et al. | 123/90.17 |
| 6,311,658 | B2 | 11/2001 | Eguchi | 123/90.17 |
| 6,374,787 | B2 | 4/2002 | Simpson et al. | 123/90.17 |
| 6,386,164 | B1 | 5/2002 | Mikame et al. | 123/90.17 |
| 6,477,996 | B2 | 11/2002 | Ogawa | 123/90.15 |
| 6,477,999 | B1 | 11/2002 | Markley | 123/90.17 |
| 6,481,402 | B1 | 11/2002 | Simpson et al. | 123/90.17 |
| 6,526,930 | B2 | 3/2003 | Takahashi et al. | 123/90.17 |
| 6,561,147 | B2 | 5/2003 | Takahashi et al. | 123/90.15 |
| 6,668,778 | B1 | 12/2003 | Smith | 123/90.17 |
| 6,684,835 | B2 * | 2/2004 | Komazawa et al. | 123/90.17 |
| 6,766,777 | B2 | 7/2004 | Simpson et al. | 123/90.15 |
| 2002/0092489 | A1 | 7/2002 | Mikame et al. | 123/90.17 |

* cited by examiner

*Primary Examiner*—Thomas Denion
*Assistant Examiner*—Kyle M. Riddle
(74) *Attorney, Agent, or Firm*—Brown & Michaels, PC; Greg Dziegielewski

(57) ABSTRACT

A VCT phaser for an engine having a housing, rotor and a spool valve. The rotor having a bore comprising an open outer end, an inner surface, and inner end having a vent port and arranged along the bore, an advance port, a common port, a retard port, and a lock port. The spool valve comprises a spool with a first land, a first groove, a second land, a second groove, and a third land, with the area between the inner surface of the bore and the first groove defining a first chamber, the area between the bore and the second groove defining a second chamber, and the area between the bore and the inner end of the spool defining a third chamber. A passage between the first groove and the second groove for fluid passage provides fluid communication between the first chamber and the second chamber and lock pin.

17 Claims, 23 Drawing Sheets

SPOOL VALVE CONTROLLED VCT LOCKING PIN RELEASE MECHANISM

REFERENCE TO RELATED APPLICATIONS

This application claims priority from pending utility application Ser. No. 10/603,637 filed Jun. 25, 2003, entitled "SPOOL VALVE CONTROLLED VCT LOCKING PIN RELEASE MECHANISM," which was disclosed in provisional application No. 60/411,921, filed Sep. 19, 2002, entitled "SPOOL VALVE CONTROLLED VCT LOCKING PIN RELEASE MECHANISM." The aforementioned application(s) are hereby incorporated herein by reference.

BACKGROUND OF THE INVENTION

1. Field of the Invention

The invention is related to a hydraulic control system for controlling the operation of a variable camshaft timing (VCT) system. More specifically, the present invention relates to a control system utilized to lock and unlock a lock pin in a VCT phaser.

2. Description of Related Art

Internal combustion engines have employed various mechanisms to vary the angle between the camshaft and the crankshaft for improved engine performance or reduced emissions. The majority of these variable camshaft timing (VCT) mechanisms use one or more "vane phasers" on the engine camshaft (or camshafts, in a multiple-camshaft engine). In most cases, the phasers have a rotor with one or more vanes, mounted to the end of the camshaft, surrounded by a housing with the vane chambers into which the vanes fit. It is possible to have the vanes mounted to the housing, and the chambers in the rotor, as well. The housing's outer circumference forms the sprocket, pulley or gear accepting drive force through a chain, belt, or gears, usually from the camshaft, or possibly from another camshaft in a multiple-cam engine.

Since the phasers cannot be perfectly sealed they are subject to oil loss through leakage. During normal engine operation, the oil pressure and flow generated by the engine oil pump is generally sufficient to keep the phaser full of oil and fully functional. However, when the engine is shut down, the oil can leak from the VCT mechanism. During engine start conditions, before the engine oil pump generates oil pressure, the lack of controlling oil pressure in the chambers can allow the phaser to oscillate excessively due to lack of oil, producing noise and possibly damaging the mechanism. Additionally, it is desirable to have the phaser locked in a particular position while the engine is attempting to start.

One solution employed in prior art phasers is to introduce a lock pin that will lock the phaser in a specific phase angle position relative to the crankshaft when insufficient oil exists in the chambers. These lock pins are typically spring loaded to engage and are released using engine oil pressure. Therefore, when the engine is shut down and engine oil pressure reaches some predetermined low value such that the spring-loaded pin will engage and lock the phaser. During engine start up, the pin remains engaged until the engine oil pump generates enough pressure to release the pin. For example, U.S. Pat. No. 6,247,434 shows a multi-position variable camshaft timing system actuated by engine oil. Within the system, a hub is secured to a camshaft for rotation synchronous with the camshaft, and a housing circumscribes the hub and is rotatable with the hub and the camshaft and is further oscillatable with respect to the hub and the camshaft within a predetermined angle of rotation. Driving vanes are radially disposed within the housing and cooperate with an external surface on the hub, while driven vanes are radially disposed in the hub and cooperate with an internal surface of the housing. A locking device, reactive to oil pressure, prevents relative motion between the housing and the hub. A controlling device controls the oscillation of the housing relative to the hub.

U.S. Pat. No. 6,311,655 shows multi-position variable cam timing system having a vane-mounted locking-piston device. An internal combustion engine having a camshaft and variable camshaft timing system, wherein a rotor is secured to the camshaft and is rotatable but non-oscillatable with respect to the camshaft is described. A housing circumscribes the rotor, is rotatable with both the rotor and the camshaft, and is further oscillatable with respect to both the rotor and the camshaft between a fully retarded position and a fully advanced position. A locking configuration prevents relative motion between the rotor and the housing, and is mounted within either the rotor or the housing, and is respectively and releasably engageable with the other of either the rotor and the housing in the fully retarded position, the fully advanced position, and in positions therebetween. The locking device includes a locking piston having keys terminating one end thereof, and serrations mounted opposite the keys on the locking piston for interlocking the rotor to the housing. A controlling configuration controls oscillation of the rotor relative to the housing.

U.S. Pat. No. 6,374,787 shows a multi-position variable camshaft timing system actuated by engine oil pressure. A hub is secured to a camshaft for rotation synchronous with the camshaft, and a housing circumscribes the hub and is rotatable with the hub and the camshaft and is further oscillatable with respect to the hub and the camshaft within a predetermined angle of rotation. Driving vanes are radially disposed within the housing and cooperate with an external surface on the hub, while driven vanes are radially disposed in the hub and cooperate with an internal surface of the housing. A locking device, reactive to oil pressure, prevents relative motion between the housing and the hub. A controlling device controls the oscillation of the housing relative to the hub.

U.S. Pat. No. 6,477,999 shows a camshaft that has a vane secured to an end thereof for non-oscillating rotation therewith. The camshaft also carries a sprocket that can rotate with the camshaft but is oscillatable with respect to the camshaft. The vane has opposed lobes that are received in opposed recesses, respectively, of the sprocket. The recesses have greater circumferential extent than the lobes to permit the vane and sprocket to oscillate with respect to one another. The camshaft phase tends to change in reaction to pulses that it experiences during its normal operation, and it is permitted to change only in a given direction, either to advance or retard, by selectively blocking or permitting the flow of pressurized hydraulic fluid, preferably engine oil, from the recesses by controlling the position of a spool within a valve body of a control valve. The sprocket has a passage extending therethrough the passage extending parallel to and being spaced from a longitudinal axis of rotation of the camshaft. A pin is slidable within the passage and is resiliently urged by a spring to a position where a free end of the pin projects beyond the passage. The vane carries a plate with a pocket, which is aligned with the passage in a predetermined sprocket to camshaft orientation. The pocket receives hydraulic fluid, and when the fluid pressure is at its normal operating level, there will be sufficient pressure within the pocket to keep the free end of the pin from entering the pocket. At low levels of hydraulic pressure, however, the free end of the pin will enter the pocket and latch the camshaft and the sprocket together in a predetermined orientation.

Other solutions employed in the prior art have separate hydraulic paths, lines, or hydraulic control systems to activate the lock pin, these separate hydraulic paths, lines, and systems may be controlled by separate spool valves or by an electric or electro-magnetic locking mechanism. For example, U.S. Pat. No. 5,901,674 discloses a separate hydraulic path to activate a lock pin which is controlled by a separate spool valve.

U.S. Pat. No. 5,941,202 discloses a separate hydraulic line to release the lock pin where the line is controlled by an electric valve.

U.S. Pat. No. 6,386,164 discloses a lock pin for a valve timing control apparatus where separate hydraulic oil passages, one for activating the lock pin and one for releasing the lock pin are independent of passages for hydraulic advancement and hydraulic retardation. The hydraulic oil passages that control the lock pin are controlled by a separate oil switching valve (OSV), rather than by end passages on the main oil control valve (OCV).

SUMMARY OF THE INVENTION

A VCT phaser for an engine having a housing, rotor and a spool valve. The rotor having a bore comprising an open outer end, an inner surface, and inner end having a vent port and arranged along the bore, an advance port, a common port, a retard port, and a lock port. The spool valve comprises a spool with a first land, a first groove, a second land, a second groove, and a third land, with the area between the inner surface of the bore and the first groove defining a first chamber, the area between the bore and the second groove defining a second chamber, and the area between the bore and the inner end of the spool defining a third chamber. A passage between the first groove and the second groove for fluid passage provides fluid communication between the first chamber and the second chamber and lock pin.

When the spool is in an outermost position closest to the outer end of the bore, one of the retard port or the advance port is blocked by the second land. The first chamber is in communication with the other of the advance port or the retard port and the common port, and the lock port is in fluid communication with the third chamber and the vent port, such that the lock pin is in a locked position.

When the spool is in a null position, the advance port and the retard port are blocked by the first land and the second land, and the lock port is in fluid communication with the second chamber, such that the lock pin is in an unlocked position.

When the spool is in an innermost position closest to the inner end of the bore, one of the retard port or the advance port is blocked by the first land. The first chamber is in communication with the other of the advance port or the retard port and the common port, and the lock port is in fluid communication with the second chamber, such that the lock pin is in an unlocked position.

DETAILED DESCRIPTION OF THE INVENTION

Internal combustion engines have employed various mechanisms to phase the angle of the camshaft relative to the crankshaft for improved engine performance or reduced emissions. One of these mechanisms is variable camshaft timing (VCT). The majority of these VCT mechanisms are operated using engine oil as the hydraulic working fluid. Since most of the VCT mechanisms are not 100% sealed they are subject to oil loss through leakage. During normal engine operation, the oil pressure and flow generated by an engine oil pump is generally sufficient to keep the VCT full of oil and thereby fully functional. However, when the engine is shutdown, the oil may tend to leak from the VCT mechanism. Therefore, during subsequent engine start conditions, the VCT may oscillate excessively due to lack of oil pressure within the VCT system.

Figure 1A:
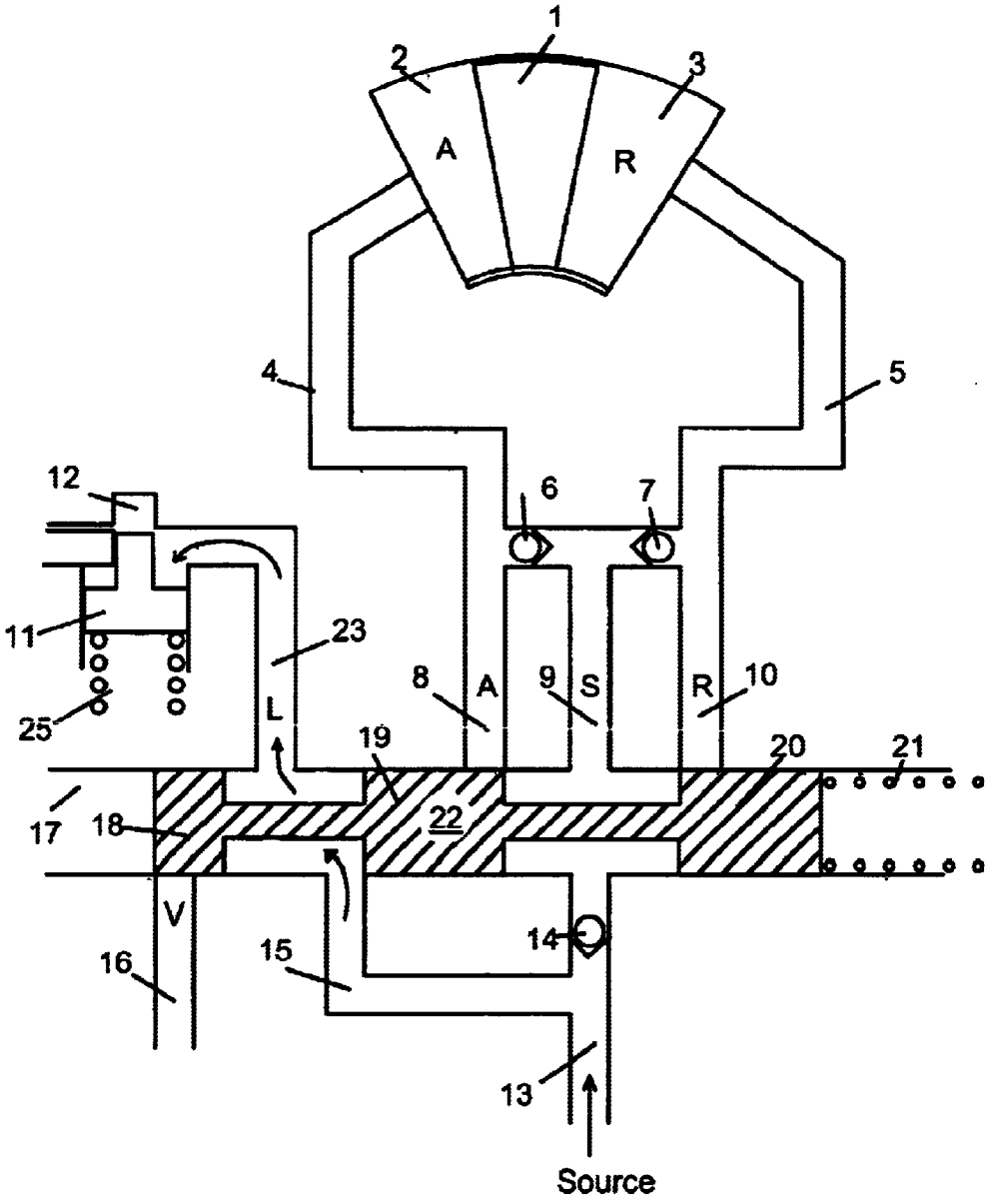
FIGS. 1*a*, 1*b*, 1*c*, and 1*d* show schematics of a first embodiment of the present invention.
Figure 1B:
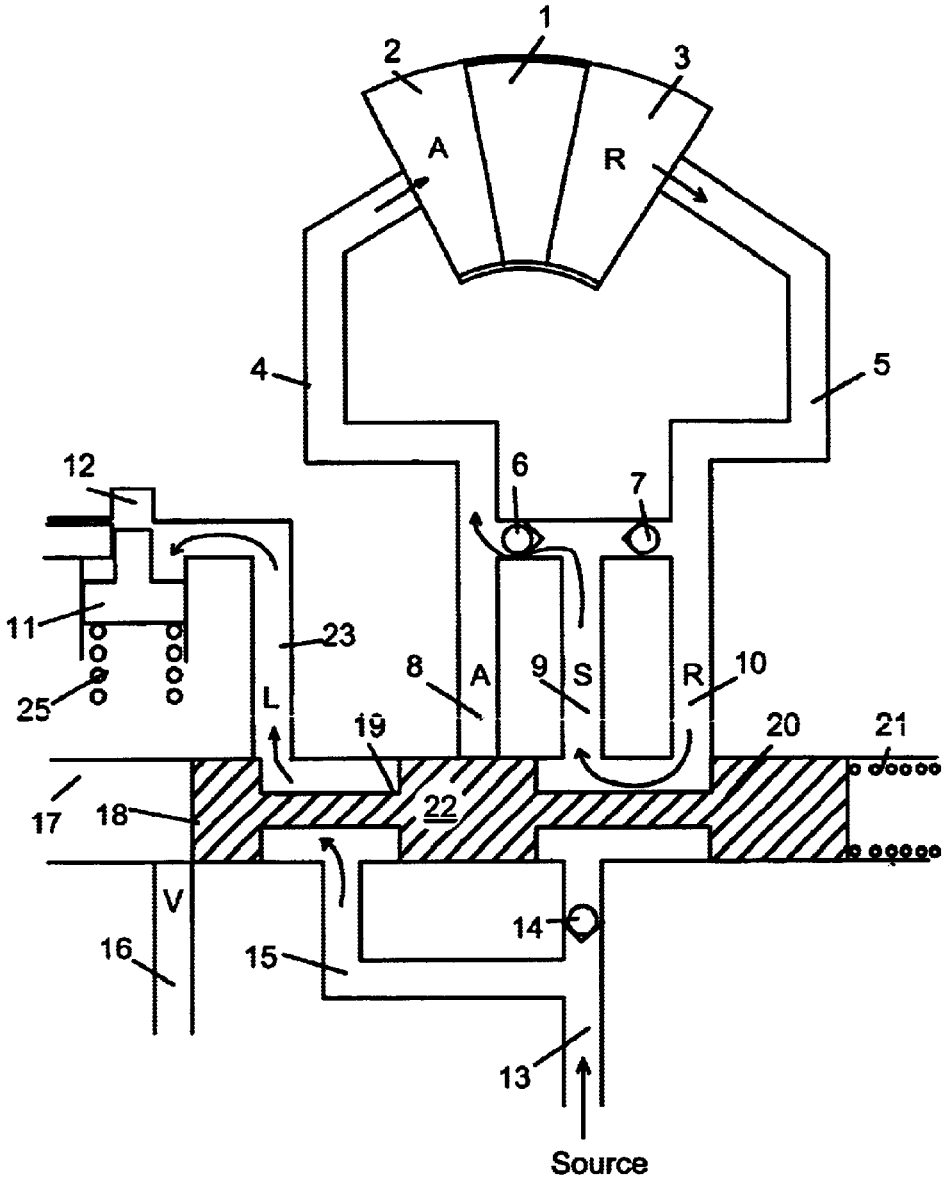
Figure 1C:
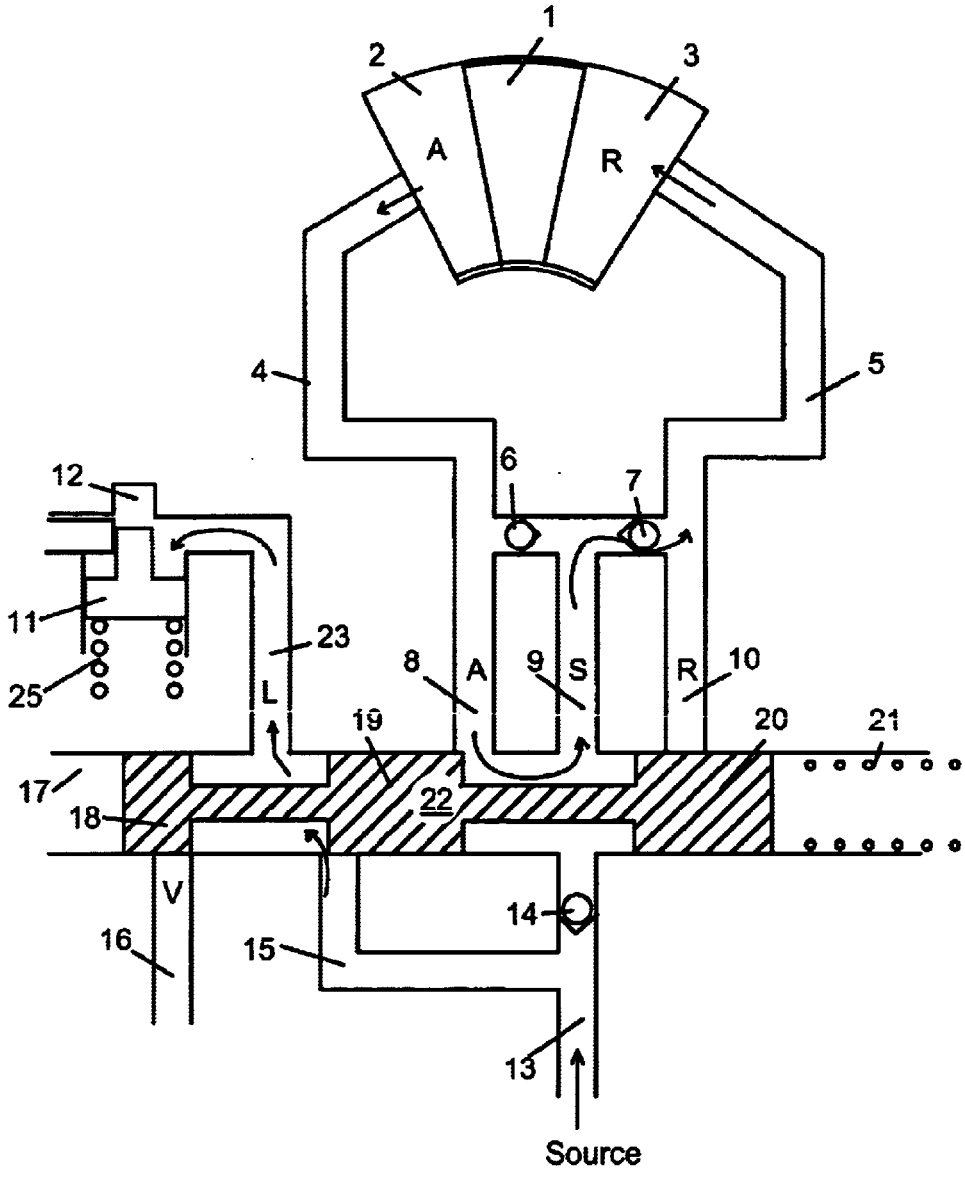
Figure 1D:
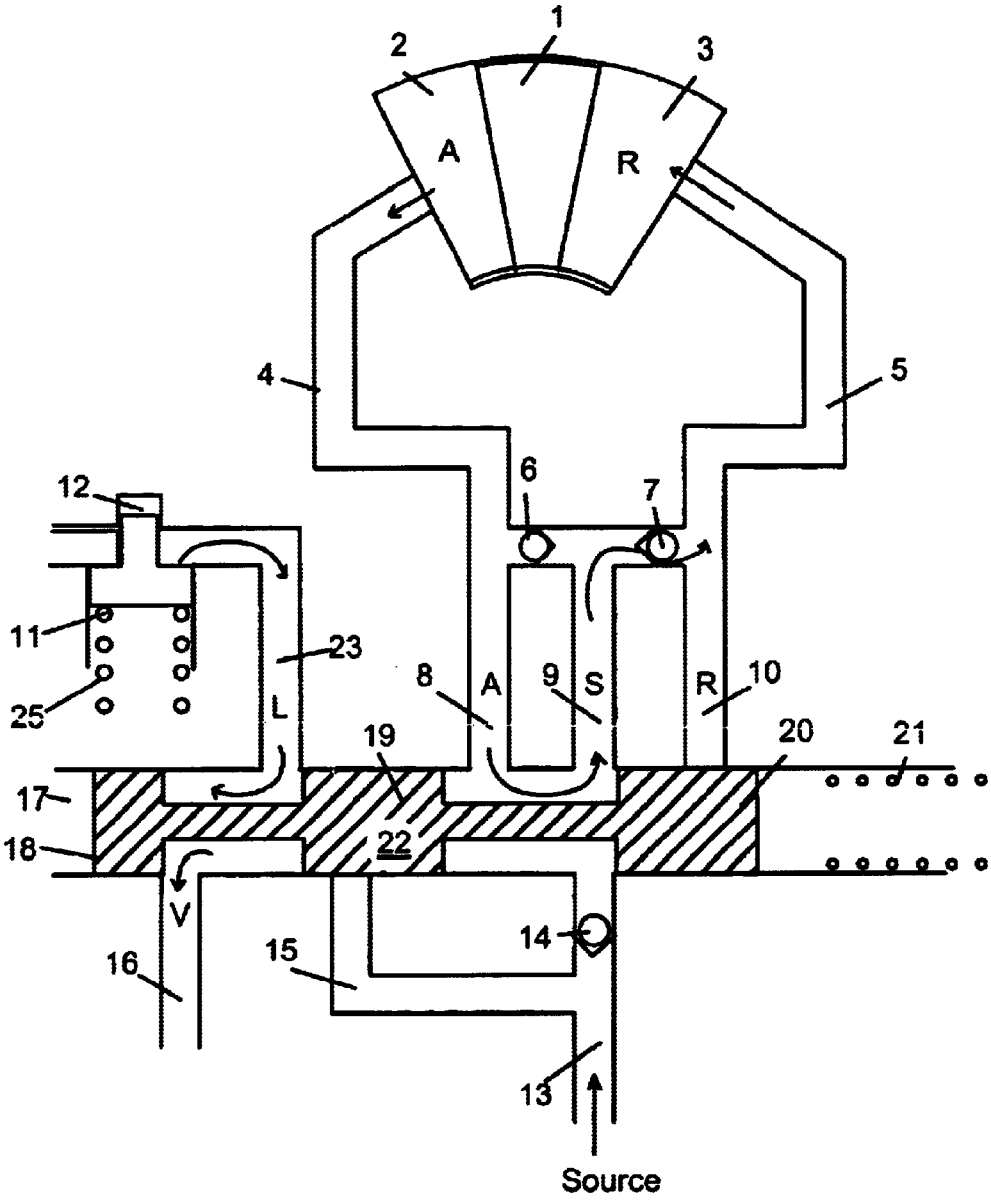

FIGS. 1*a* to 1*d* show the control system of the present invention in the following positions: null (FIG. 1*a*), advance (FIG. 1*b*), retard with lock pin released (FIG. 1*c*) and retard with lock pin engaged (FIG. 1*d*). In each of the figures, a cylindrical spool 22, having three lands 18, 19, 20, rides in bore or sleeve 17. The engine oil supply 13 is routed to the bore 17 through passage 14, which has a check valve therein, and a first passage 15 which is in direct fluid communication with a source of oil such as an engine oil supply 13. It is noted that the source of oil provides means for normal VCT mechanism. In other words, without the first passage 15, engine oil supply 13 still maintains the oil supply for the VCT mechanism. First passage 15 branches off engine oil supply 13 for implementing the present invention. Passage 16 vents to the engine oil sump (not shown) and allows oil to flow from the lock pin 11 back to the oil sump or oil supply sump. A second passage or lock passage 23 leads to a lock pin 11 which is disposed to fit into a recess 12 to thereby lock the phaser in position. The second passage 23 is used for directing oil to and from the lock pin 11.

Branch line 8 leads to advance chamber 2, and branch line 10 similarly leads to retard chamber 3. The two chambers 2, 3 are separated by a vane 1, which is part of the rotor. In a "cam torque actuated" (CTA) phaser of the kind shown in FIGS. 1*a*–1*d*, passage 9, with check valves 6, 7, provides a recycling line to allow actuated fluid to pass from the advance chamber 2 to the retard chamber 3 and vice versa. The direction of the actuated fluid depends on the position of the spool valve, in the manner similarly described in patent U.S. Pat. No. 5,107,804, which is hereby incorporated herein by reference. It will be understood by one skilled in the art, however, that the system of the invention can be used in phasers which are directly energized or moved by oil pressure, hybrid arrangements, or any other arrangement which uses a single spool valve to control the phaser.

Referring back to FIG. 1*a*, the spool 22 is in the null position. The first land 18 blocks the vent passage or the third passage 16 that prevents source oil from draining from the lock pin 11. The second land 19 blocks source oil from the advance branch line 8 and the third land 20 blocks source oil from the retard branch line 10. The makeup source oil supplied to the spool 20 and subsequently the branch lines 8, 10 are supplied via a supply line containing a check valve 14 to prevent the return of oil from the spool 22 into the source during pressure pulses due to torque reversals.

With both the advance and retard branch lines 8, 10 blocked, source oil can only travel towards the advance and retard chambers 2, 3 through the source branch line 9 to make up for oil lost due to leakage. The source branch line 9 ends in a cross-section marked by check valves 6, 7. Again, with both the advance and retard branch lines 8, 10 blocked, neither check valve 6, 7 is closed, thereby allowing source oil to go through both the advance and retard lines 4, 5. This way, both the advance and retard chambers 2, 3 are kept filled with oil. However, oil cannot flow from advance chamber 2 to retard chamber 3, or vice versa. Thereby vane 1 is effectively locked in position. As can be seen, with the spool 22 in this position, i.e. null position, the source oil still freely supplies oil to the lock pin 11 via a supply line or first passage 15, thereby forcing the lock pin 11 to remain disengaged from the recess 12.

FIG. 1*b* shows the spool 22 in the advanced position. The second land 19 blocks the advance branch line 8 from exhausting oil from the advance chamber 2. The third land 20 no longer blocks the retard branch line 10, thereby allowing source oil and oil that is exiting the retard chamber 3 to flow through the source branch line 9 and check valve 6 to the advance line 4, to fill up the advance chamber 2, simultaneously allowing cam torque reversals to move the vane 1 accordingly. Similar to FIG. 1*a*, source oil is still being supplied to the lock pin 11, thereby maintaining the lock pin 11 disengaged from recess 12.

FIG. 1*c* shows the spool in a retard position, with the lock pin disengaged or unlocked. The amount of oil supplied to the lock pin 11 is still adequate in quantity to keep the lock pin 11 from engaging recess 12. The third land 20 completely blocks the retard branch line 10. The source oil and the oil exiting from the advance chamber 2 moves through the branch line 4 to the source branch line 9 and through the check valve 7 to the retard branch line 10 leading into the retard chamber 3, filling the retard chamber 3 and thereby allowing cam torque reversals to move the vane toward the retard position. Similar to FIGS. 1*a* and 1*b*, source oil is still being supplied to the lock pin 11, thereby maintaining the lock pin 11 disengaged from recess 12.

FIG. 1*d* shows the spool 22 in the retard position, with the lock pin engaged. The first land 18 no longer blocks the vent passage 16. The second land 19 now blocks the supply line 15 of source oil that was maintaining the lock pin 11 in a disengaged position; and no longer blocks the advance branch line 8 from source oil. The third land 20 now blocks the retard branch line 10 from the source oil. With the lands 18, 19, 20 in these specific positions, source oil flows through the check valve 14 into the bore 17 containing the spool 22. The source oil in combination with the oil exiting from the advance chamber 2 moves through the check valve 7 to the retard branch line 10 to fill the retard chamber 3 and move vane 1 accordingly. The lock pin 11 engages recess 12, since the supply of oil is no longer present and the remaining oil is drained off through the vent passage or third passage 16.

It is understood that the lock pin could disengage the rotor when the VCT mechanism is in the retard and null state, and the lock pin could engage the rotor when the VCT mechanism in the advanced state, as within the teachings of the invention, by reversing the positions of land 18 and passages 15, 16 and 23 on the other end of the spool. As can be seen by referring to FIGS. 1*a*–1*d*, pin 11 is counter balanced by an elastic element 25 biased upon or engaging in an opposite end in relation to the end which is in fluid contact with oil within the second passage 23. The force exerted by the elastic element 25 is substantially constant. Further, elastic element 25 may be a spring, or more specifically, a metal spring.

Figure 2:
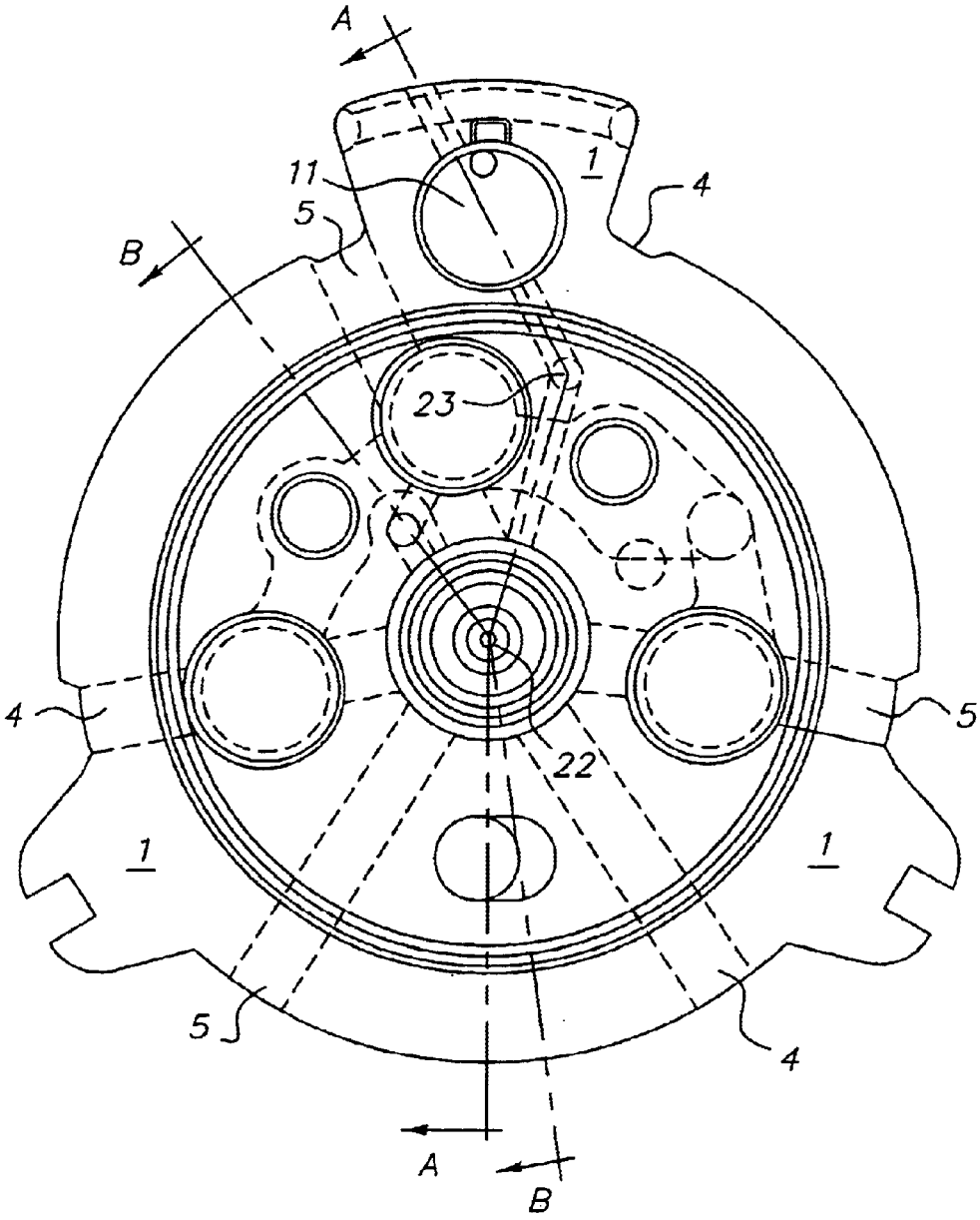
FIG. 2 shows a cross-sectional view of the VCT phaser of the first embodiment having a lock pin with inlet and outlet passages connected thereto.
Figure 3:
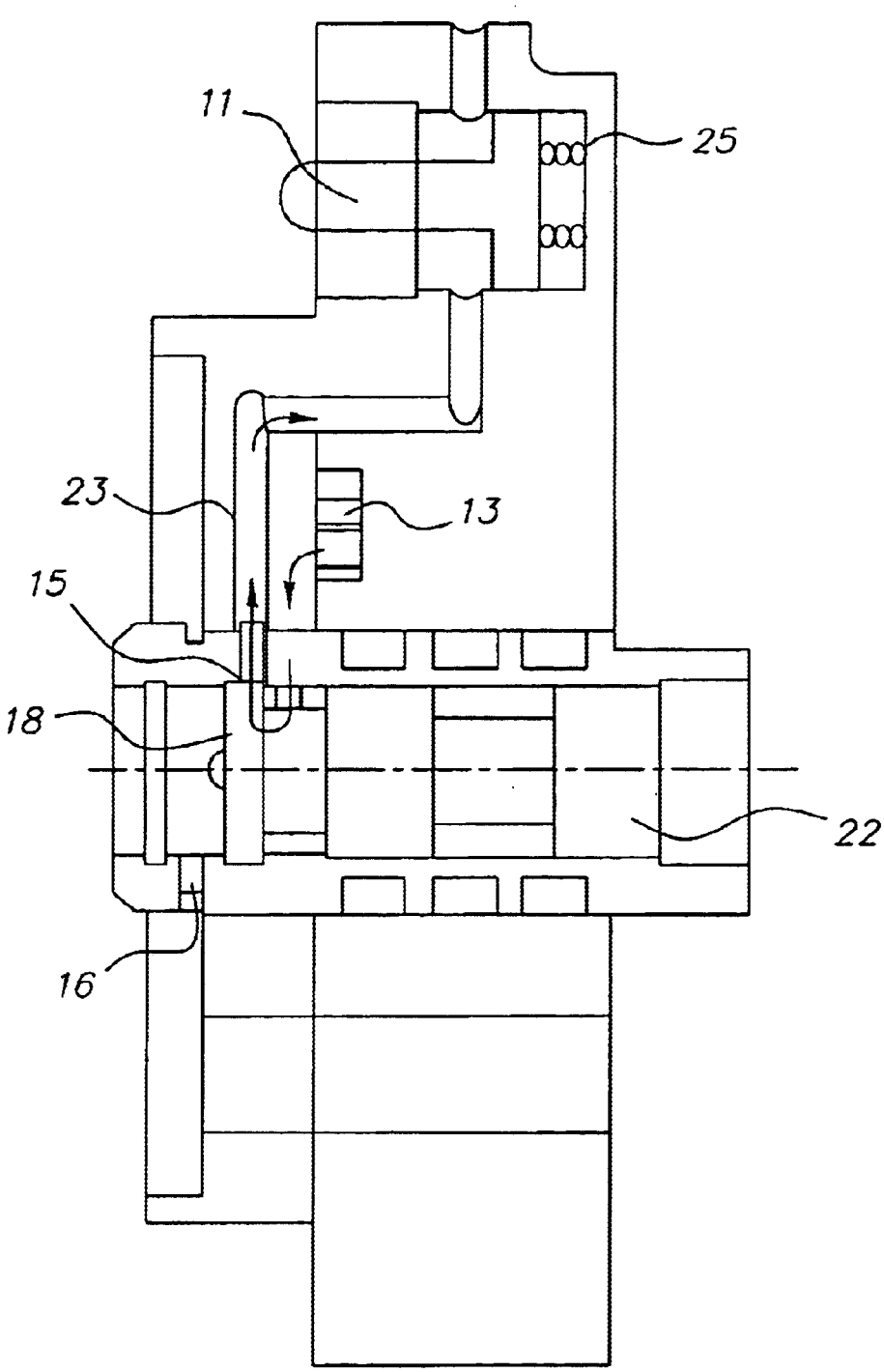
FIG. 3 shows a cross-sectional view taken along line A—A in FIG. 2.
Figure 4:
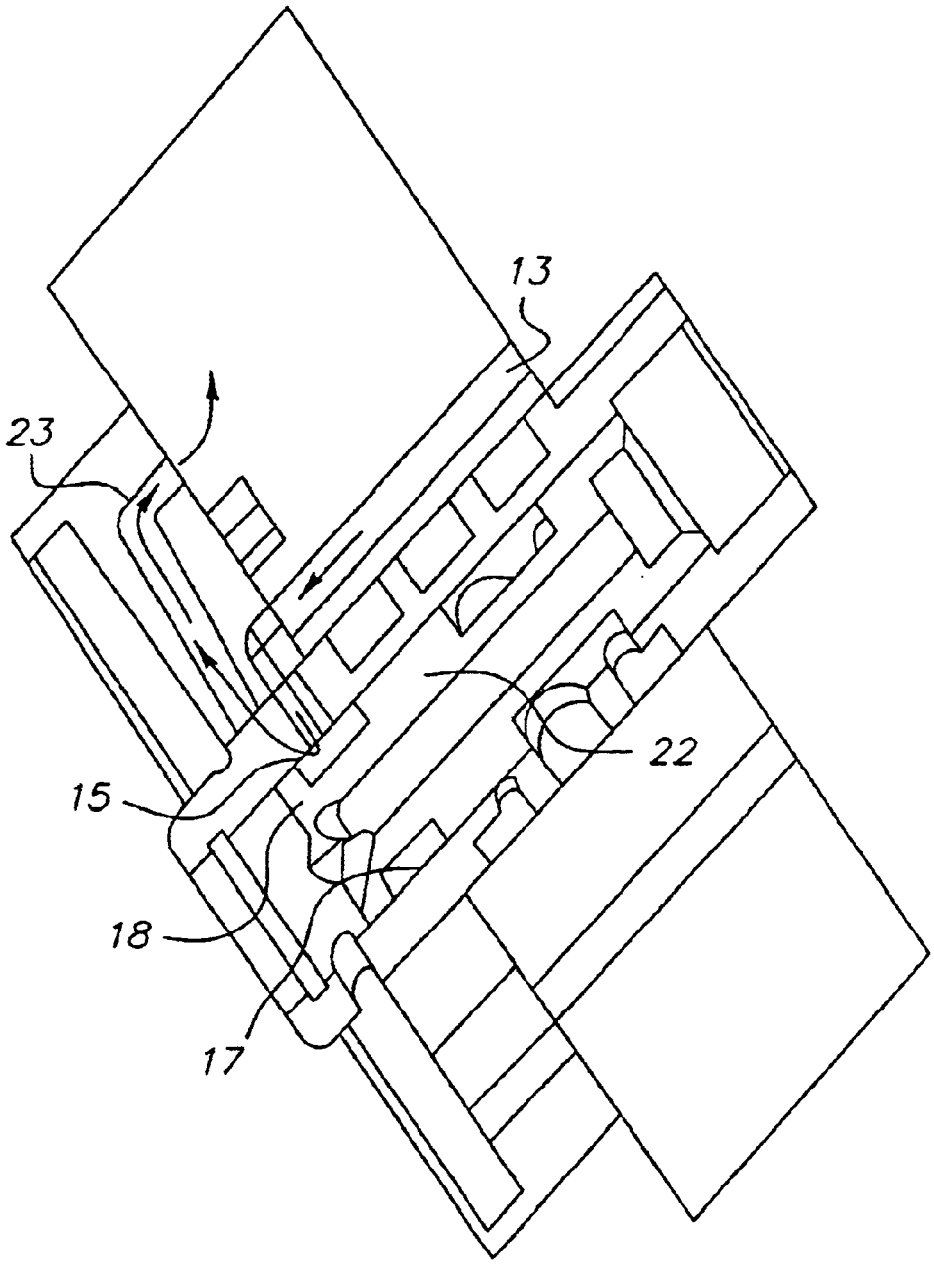
FIG. 4 is a cross-sectional view taken along line B—B in FIG. 2.

FIG. 2 shows a cross-sectional view of a phaser. FIGS. 3 and 4 show cross-sectional views along lines A—A and B—B of FIG. 2. In general, the figures show how the control system of the invention may be fitted into a cam phaser of the type having a spool valve in the center of the rotor. The spool in turn has an extra land 18 for controlling energized fluid which flows to and from the proximity of lock pin 11, including passage 23 and passage 16.

Referring to FIG. 2, a face view of portions of a phaser of the present invention is shown. More specifically, FIG. 2 shows lock pin 11 and passages 23 to/from the lock pin 11 in face view. The rotor that oscillates within the housing (not shown) in which three vanes 1 circumferentially extended therefrom and formed thereon is shown. At the center of rotor are circumferential openings of a substantially cylindrical shape that permits spool 22 to move therein. Two sets of holes, each comprising of the same are provided. Further, note the second passage 23 facilitates fluid communication between the source (not shown) and the pin 11. In addition, passages 4 and 5 function as described in relation to FIGS. 1*a*–1*d*.

Referring to FIG. 3, a cross-sectional view along line A—A of FIG. 2 is shown. More specifically, FIG. 3 is a cross section that shows the lock pin passage 23 and the vent passage 16. Source 13 supplies oil and spool valve 22 is slidably positioned at the center of the rotor 4. Vent passage 16 channels out excessive oil.

Referring to FIG. 4, a cross-sectional view along line B—B of FIG. 2 is shown. More specifically, FIG. 4 is a cross-section that shows the lock pin passage 23, the source passage 13, and passage 15. Spool 22 controllably moves or slides in a bore at the center of rotor 4 and is limited in travel by the length of the bore 17.

The following is an example that shows the function of the present invention which uses only one or rather a single spool valve (as opposed to separate spool valves for controlling the vane 1 and controlling the lock pin 11 respectively) is that when the spool valve 22 moves out it simultaneously commands or accomplishes two functions. First, "spool out" commands the VCT or phaser to move to a stop. This stop can be either full advance or full retard depending on the layout of hydraulic passages. By locating the lock pin 11 at the full advance or full retard stop the VCT system then automatically finds the locked position. The second command is to turn off the source oil and vent the lock pin 11 via vent passage 16 thereby allowing lock pin 11 to extend into and engage recess 12.

As can be appreciated, compared with known VCT lock systems that use separate spool valves for controlling hydraulic passages, and compared with known VCT lock systems that uses source oil pressure for locking and unlocking a phaser without routing the source oil via the proximity of a single spool such as the center positioned spool 22 as shown in the present invention, both function can be performed more efficiently. In other words, the present invention provides only one spool valve 22 to perform the above two functions (i.e. phase the VCT to a position and engage the lock) as can seen in FIGS. 1*a*–1*d*.

The present invention further provides a unique feature that combines the above two functions. This feature can be portrayed, for example, by referring back to FIGS. 1*a*–1*d*. For instance when the spool valve 22 is moving out and crosses the null position, the first command based on spool position is to move the VCT to the locked position. The second command occurs after the spool valve moves out further. So, the sequence of events when the spool valve 22 is moving out is to relocate the VCT first and then lock pin 11 second. When the spool valve is "moved in," the staging of events is reversed. The first little movement of the spool valve first unlocks the VCT, even before the spool valve reaches null. After moving in, past null position, the VCT can then move off the locked position. This is desirous because if you command the VCT to move before the lock pin is disengaged one tends to wedge the lock pin in place and not be able to unlock the VCT via the actuating force against the pin. As can be seen, the present invention forestalls control strategies that need to give the VCT enough time to release before commanding it away from the locked position.

Another desirous result of the present invention is that when the spool valve is moved in then the first action to occur is to disengage the lock pin 11. This occurs even before the spool valve 22 moves far enough to command the VCT to move.

Figure 5A:
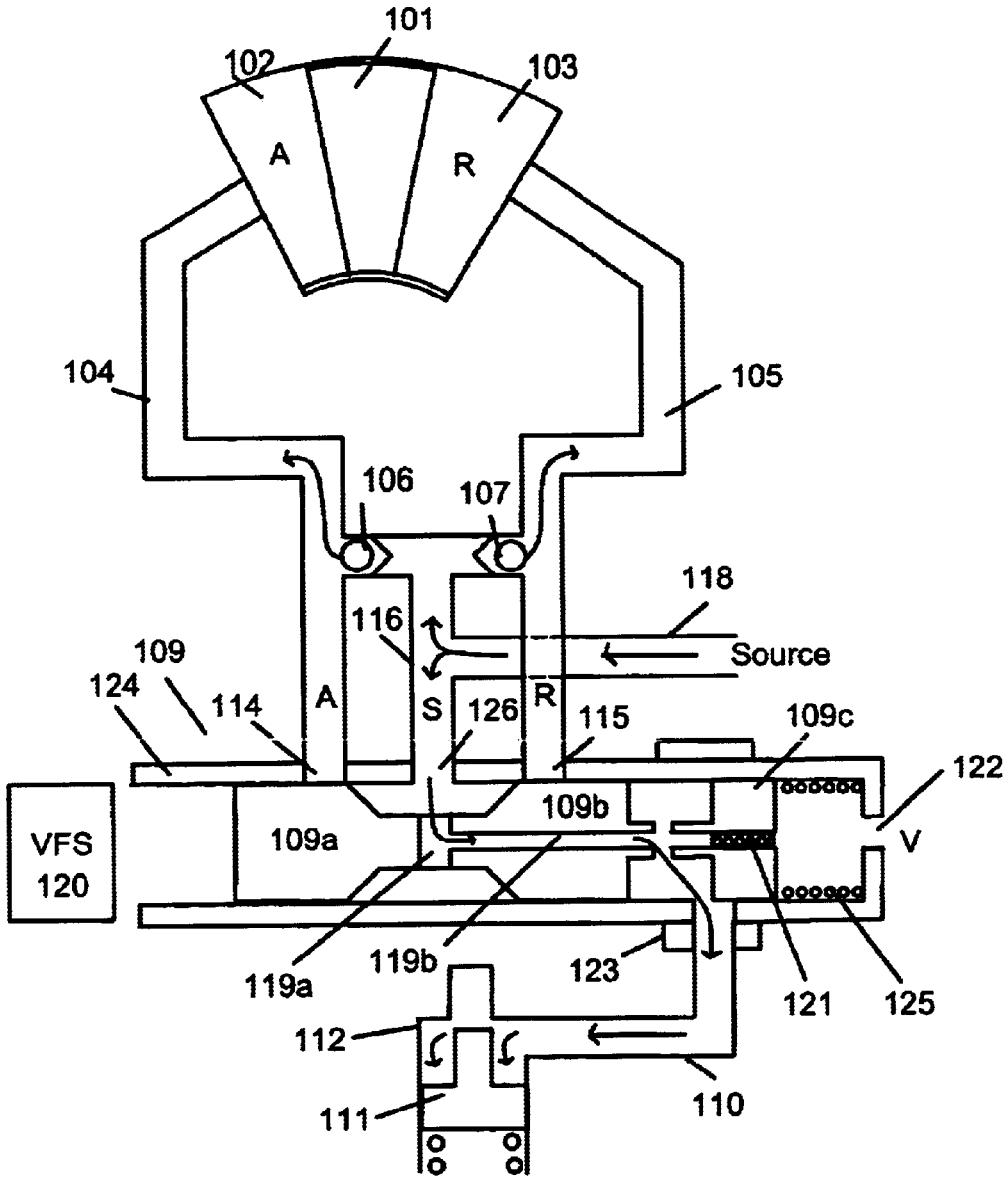
FIGS. 5*a*, 5*b*, and 5*c* show schematics of second embodiment of the present invention in a cam torque actuated phaser.
Figure 5B:
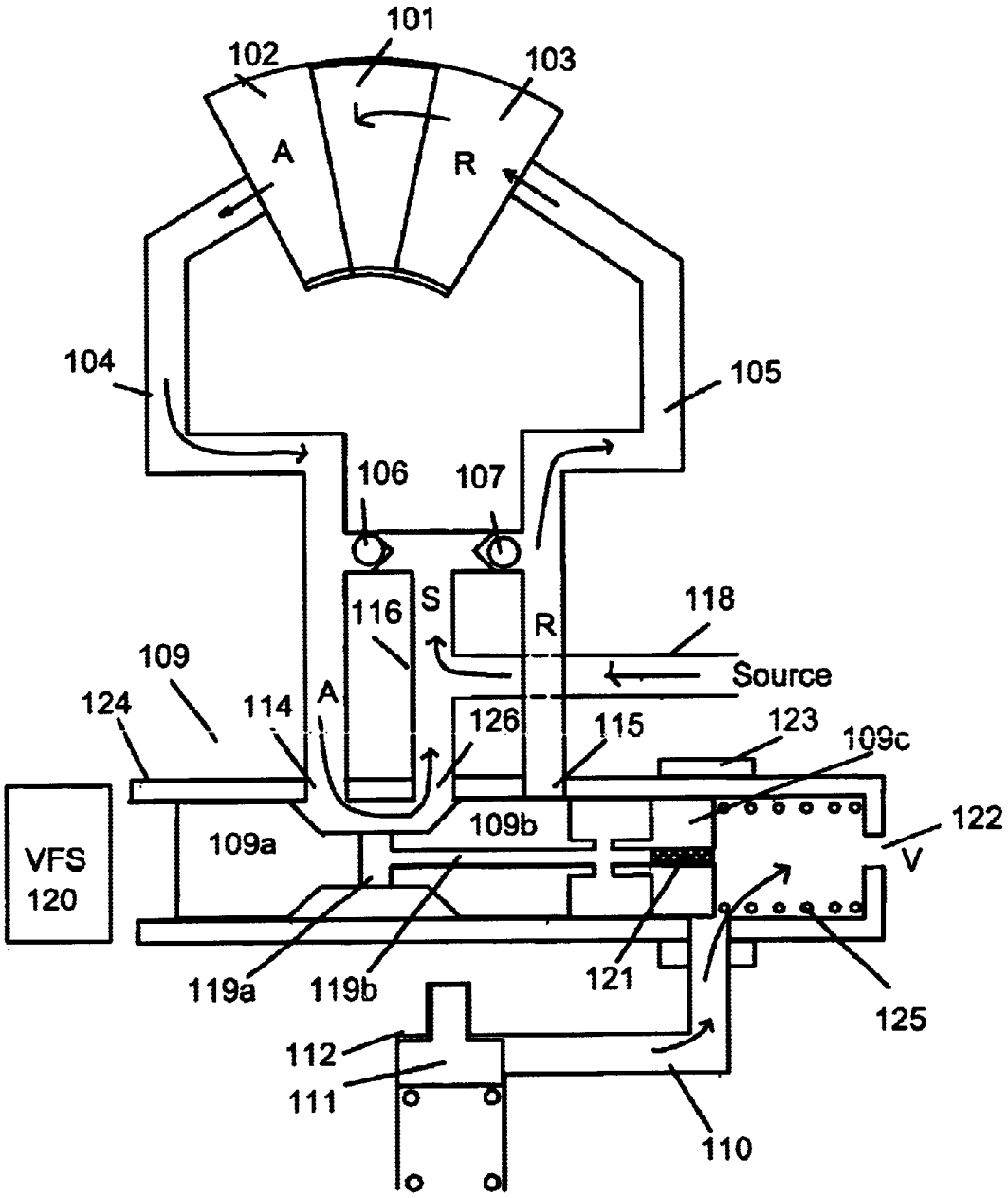
Figure 5C:
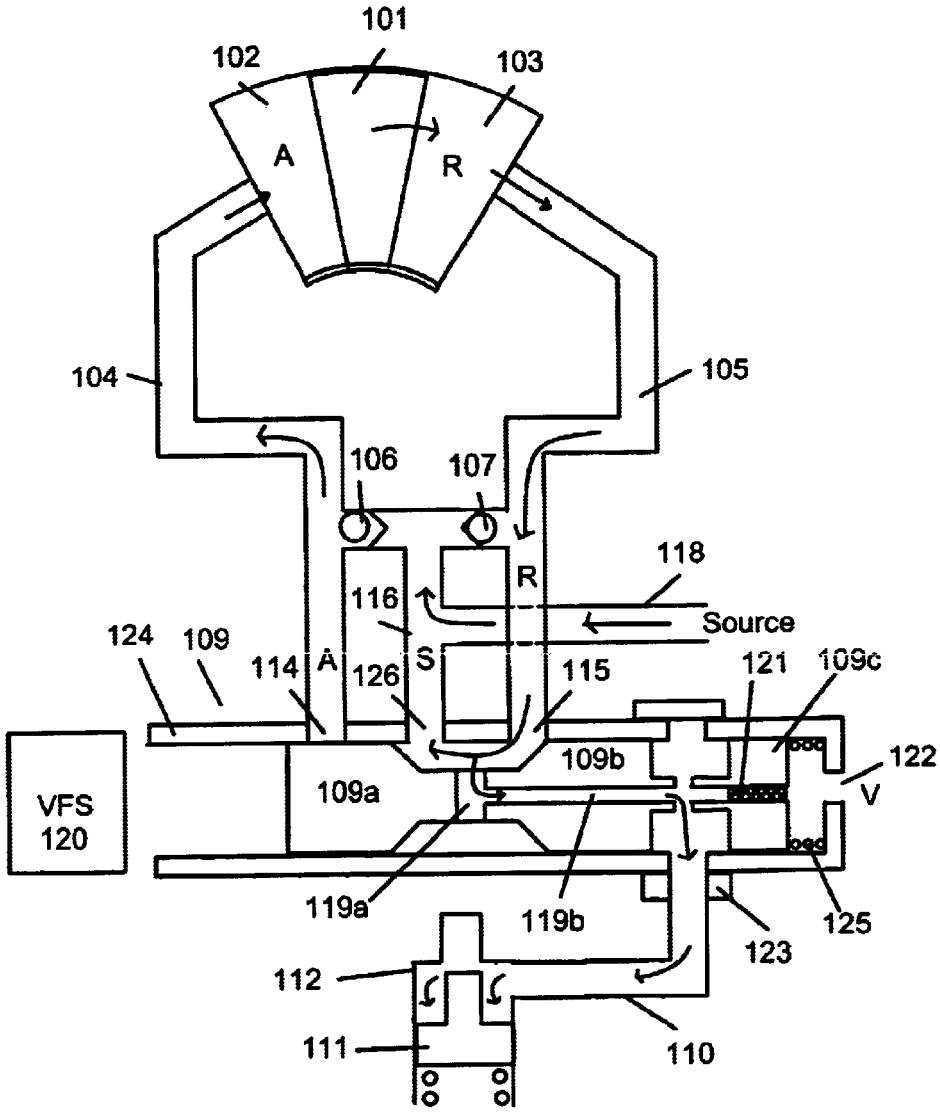
Figure 6:
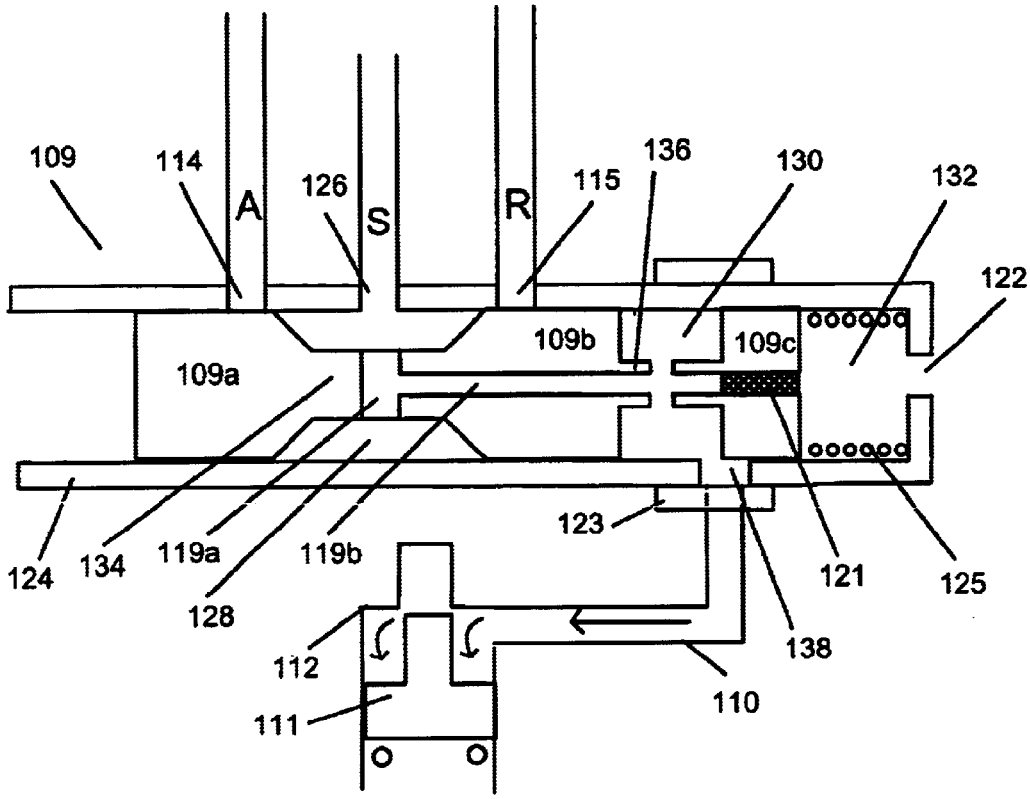
FIG. 6 shows a close-up of the axial cylindrical bore housing the spool of FIG. 5*a*.

FIGS. 5*a* through 6 show schematics of a second embodiment of the present invention in a cam torque actuated phaser. FIG. 5*a* shows the cam torque actuated phaser of the second embodiment in the null position. FIG. 5*b* shows the cam torque actuated phaser of the second embodiment in the retard position. FIG. 5*c* shows the cam torque actuated phaser of the second embodiment in the advance position. FIG. 6 shows a close-up of the spool in FIG. 5*a*.

Referring to FIGS. 5*a* and 6, hydraulic fluid enters the phaser from supply line 118 to common line 116. From the common line 116, the fluid goes to advance and retard chambers 102, 103 and the common port 126 of the spool valve 109. The fluid that goes to the advance and retard chambers 102, 103 moves through check valves 106, 107 to lines 104, 105 that have one end leading to the advance and retard chambers 102, 103 respectively and another end leading to the advance and retard ports 114, 115. The spool 109 is internally mounted within an axial cylindrical sleeve or bore 124 which receives spool lands 109*a*, 109*b*, and 109*c*, grooves 134, 136, and a biasing spring 125. The spool 109, from an outer end to an inner end, the ends being defined in relation to the axial bore 124, comprises a first land 109*a*, a first groove 134, a second land 109*b*, a second groove 136, and a third land 109*c*. An inner surface of the bore 124 and the first groove 134 define a first chamber 128. Another part of the inner surface of the bore 124 and the second groove 136 define a second chamber 130. The inner end of the spool 109 and the bore 124 define a third chamber 132. A passage 119*a* is present in the first groove 134 and leads to another passage 119*b* in the second land 109*b* and groove 136, allowing fluid passage between the first chamber 128 and the second chamber 130.

The bore 124 has an open outer end, an inner surface, and an inner end having a vent port 122. The ports 114, 126, 115, 138 to the advance line 104, the common line 116, the retard line 105, and the line 110 to the lock pin 111 within its own bore 112, respectively, are all arranged along the bore 124. As shown in FIGS. 5*a* through 5*c*, and specifically FIG. 6, the ports are arranged from the open outer end to the inner end having a vent port 122, in the following order, advance port 114 in fluid communication with advance chamber 102 via the advance line 104, the common port 126 in fluid communication with the common line 116, the retard port 115 in fluid communication with the retard chamber 103 via the retard line 105, and the lock port 138 in fluid communication with lock pin 111 via line 110.

A variable force solenoid (VFS) (shown schematically) 120 which is controlled by an engine control unit (ECU) (not shown), moves the spool 109 within the bore 124. In the null position, fluid is prevented from exiting the advance and the retard chamber 102, 103 through lines 104, 105 by spool lands 109*a* and 109*b*. The fluid that does go to the spool 109 through common port 126, enters the first chamber 128 and spool passage 119*a* in the first groove 134 between the spool lands 109*a* and 109*b*. From the first spool passage 119*a*, fluid moves to spool passage 119*b*, which passes through spool land 109*b* entirely to the second chamber 130. From the second chamber 130, fluid enters port 138 to line 110 leading to bore 112 housing the lock pin 111. The fluid is of sufficient pressure and force to push the lock pin 111 against the biasing spring, causing the lock pin 111 to be in the unlocked position. Fluid does not vent from the bore 124 due to the position of spool land 109*c*. Spool land 109*c* contains a plug 121. Line 110 is connected to port 138 of the bore 124 by an annulus 123.

FIG. 5*b* shows the cam torque actuated phaser of the second embodiment in the retard position. For the retard position, the force of the biasing spring 125 is greater than the force of the VFS 120 (shown schematically) and the spool 109 is moved to the left in the drawing, causing the placement of spool land 109*b* to block retard port 115 and retard line 105. Spool land 109*c* blocks fluid from the second chamber 130 to lock port 138 and line 110 connected to the lock pin 111. Since fluid from spool passage 119*b* cannot reach line 110 or lock pin 111, the force of the biasing spring locks the lock pin 111 and fluid from the lock pin 111 exits through lock port 138 and line 110 to the third chamber 132, which is exhausted through vent port 122.

Hydraulic fluid enters the phaser from supply line 118 to common line 116. From common line 116, the fluid goes to the retard chamber 103 through check valve 107 and retard line 105. Fluid in the advance chamber 102, exits through advance line 104 and advance port 114 to the first chamber 128. From the first chamber 128, fluid enters port 126 and common line 116. Fluid from the common line 116 goes to the retard chamber 103 as described above. A small amount of fluid from the first chamber 128 will go into spool passages 119*a* in the first groove 134 between lands 109*a* and 109*b*. From spool passage 119*a*, fluid moves to spool passage 119*b*, which passes entirely through spool land 109*b* to the second chamber 130. However, as explained above, the fluid is prevented from entering lock port 138 and line 110.

FIG. 5*c* shows the cam torque actuated phaser of the second embodiment in the advance position. For the advance position, the force of the biasing spring 125 is less than the force of the VFS 120 (shown schematically) and the spool 109 is moved to the right in the drawing, causing the placement of the spool land 109*a* to block advance port 114 and advance line 104.

Hydraulic fluid enters the phaser from supply line 118 to common line 116. From the common line 116, fluid goes to the advance chamber 102 through check valve 106 and advance line 104. Fluid in the retard chamber 103, exits through retard line 105 and retard port 115 to the first chamber 128. From the first chamber 128, fluid enters port 126 and common line 116 or spool passages 119*a* in the first groove 134 between lands 109*a* and 109*b*. Fluid that enters the common line 116 goes to the advance chamber 102 as described above. The fluid that enters the spool passages 119*a* moves to spool passage 119*b*, which passes entirely through spool land 109*b* to the second chamber 130. From the second chamber 130, fluid enters lock port 138 to line 110 leading to bore 112 housing the lock pin 111. The fluid is of sufficient pressure and force to push the lock pin 111 against the biasing spring, causing the lock pin 111 to be in the unlocked position. Fluid does not vent from bore 124 due to the position of spool land 109*c*. Spool land 109*c* contains a plug 121.

Figure 7A:
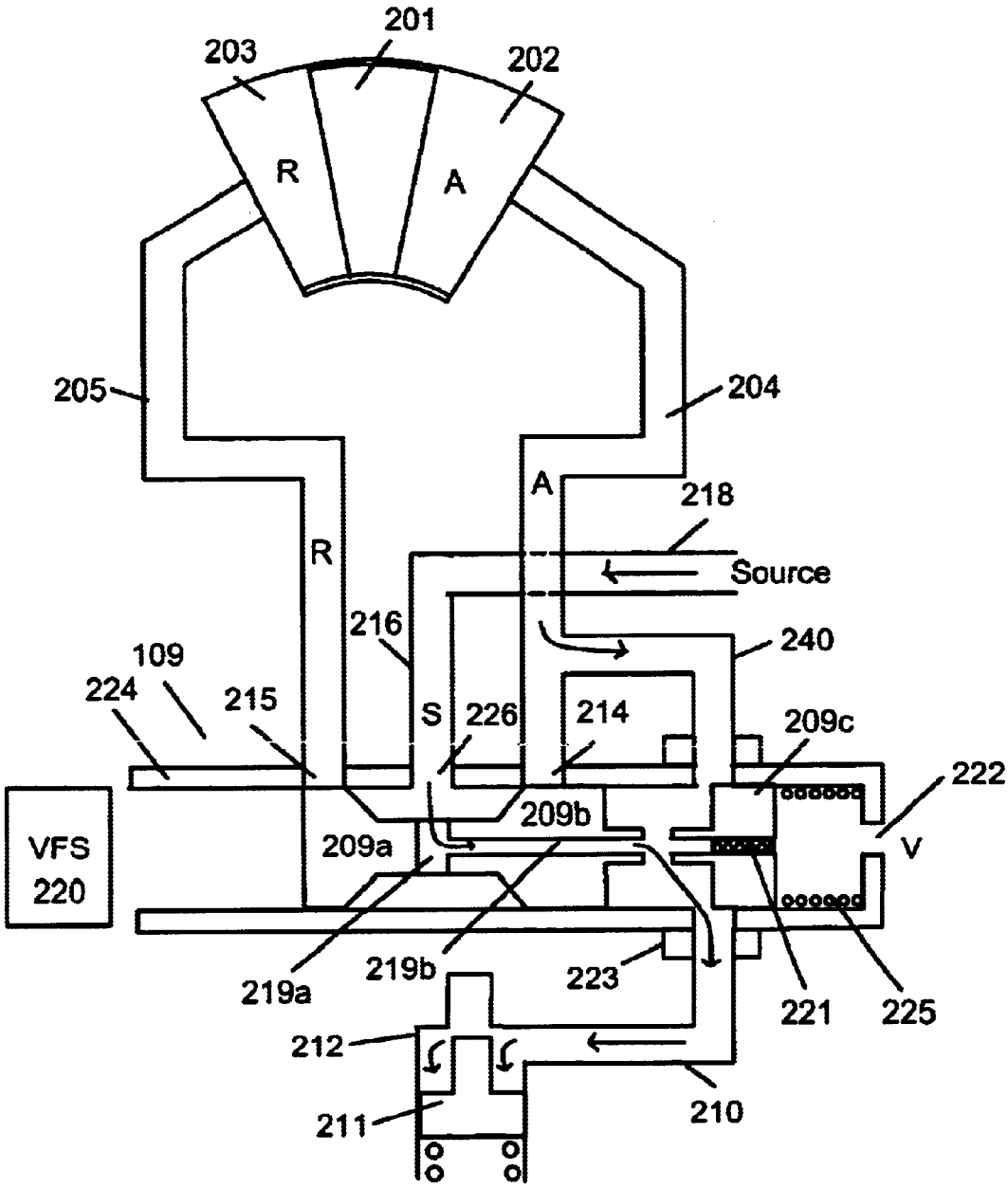
FIGS. 7*a*, 7*b*, and 7*c* show a third embodiment of the present invention in an oil pressure actuated phaser.
Figure 7B:
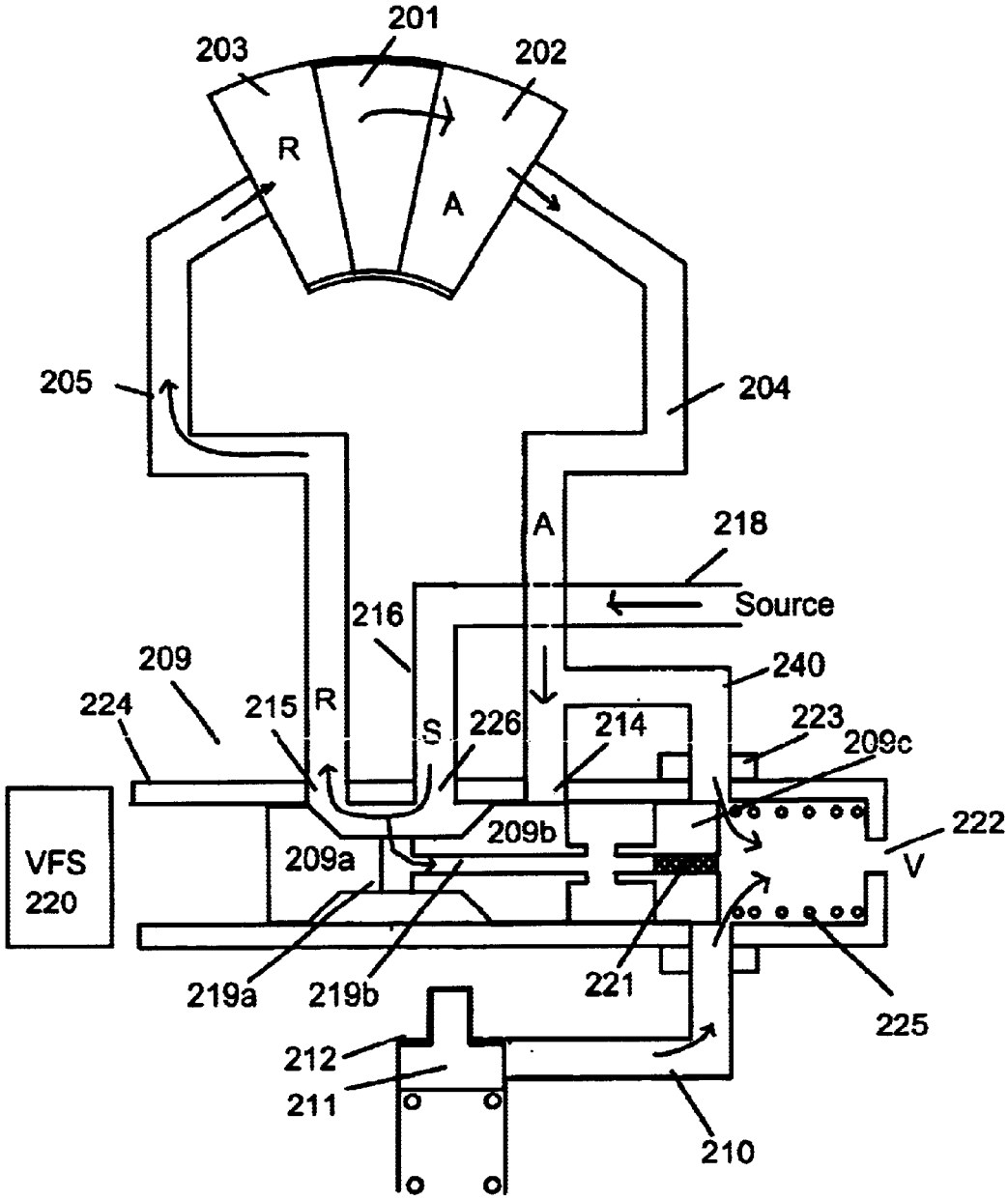
Figure 7C:
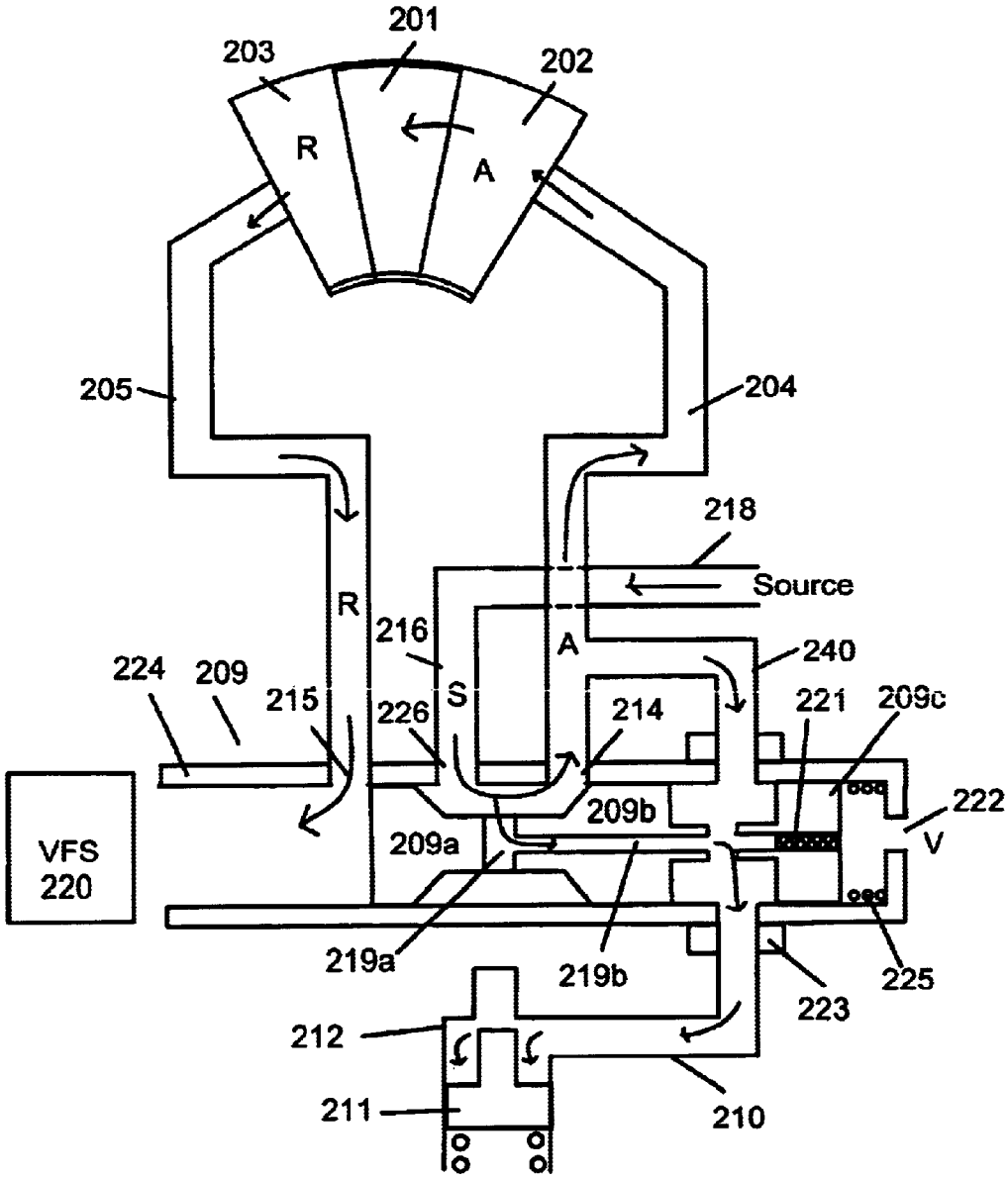
Figure 8:
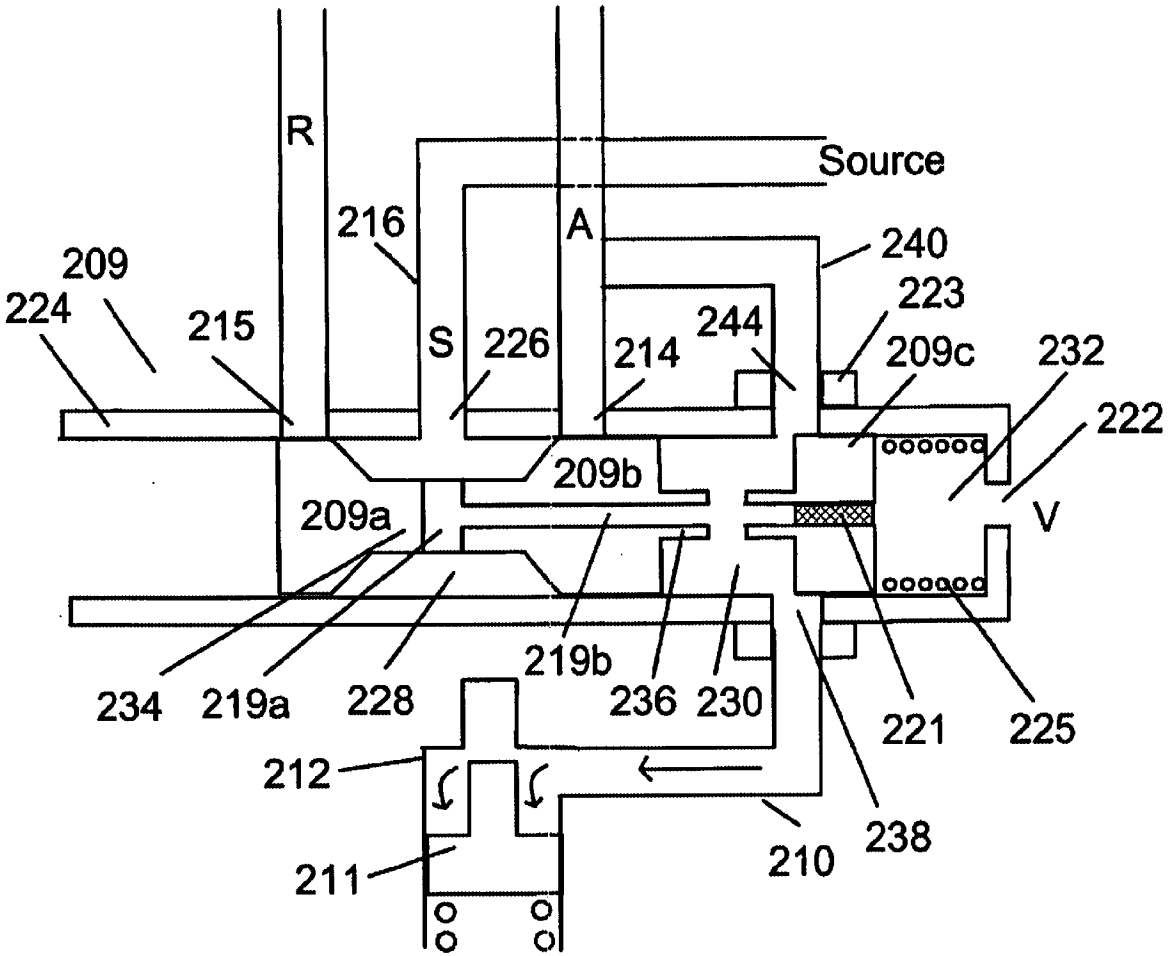
FIG. 8 shows a close-up of the axial cylindrical bore housing of the spool of FIG. 7*a*.

FIGS. 7*a* through 8 show schematics of a third embodiment of the present invention in an oil pressure actuated phaser. FIG. 7*a* shows the oil pressure actuated phaser of the third embodiment in the null position. FIG. 7*b* shows the oil pressure actuated phaser of the third embodiment in the retard position. FIG. 7*c* shows the oil pressure actuated phaser in the advance position. FIG. 8 shows a close-up of the spool in FIG. 7*a*.

Referring to FIGS. 7*a* and 8, hydraulic fluid enters the phaser from supply line 218 to line 216 and port 226 of bore 224. The bore 224 has an open outer end, an inner surface, and an inner end having a vent port 222. The ports 214, 226, 215, 238, 244 to the advance line 204, line 216, the retard line 205, line 210 to the lock pin 211 within it's own bore 212, and a second advance line 240 respectively, are all arranged along the bore 224. As shown in FIGS. 7*a* through 7*c*, and specifically FIG. 8, the ports are arranged from the open outer end to the inner end having a vent port 222, in the following order, advance port 214 in fluid communication with the advance chamber 202 via the advance line 204, port 226 in fluid communication with line 216, the retard port 215 in fluid communication with the retard chamber 203 via the retard line 205, the lock port 238 in fluid communication with lock pin 211 via line 210, and a second advance port 240 in fluid communication with a second advance line 240.

The bore 224 also houses the internally mounted spool 209, which receives spool lands 209*a*, 209*b*, and 209*c*, grooves 234, 236, and biasing spring 225. The spool 209, from an outer end to an inner end, the ends being defined in relation to the bore 225, comprises a first land 209*a*, a first groove 234, a second land 209*b*, a second groove 236, and a third land 209*c*. An inner surface of the bore 224 and the first groove 234 define a first chamber 228. Another part of the inner surface of the bore 224 and the second groove 236 define a second chamber 230. The inner end of the spool 209 and the bore 224 define a third chamber 232. A passage 219*a* is present in the first groove 234 and leads to another passage 219*b* in the second land 209*b* and groove 236, allowing fluid passage between the first chamber 228 and the second chamber 230.

Fluid from port 226, enters the first chamber 228 and spool passage 219*a*, when the phaser is in the null position, and lands 209*a* and 209*b* block ports 205, 204 and lines 215, 214, leading to the retard and advance chamber respectively, as shown in FIG. 7*a*. From spool passage 219*a*, in the first groove 234 between spool lands 209*a* and 209*b*, fluid enters spool passage 219*b*, which passes through spool land 209*b* entirely to the second chamber 230. From the second chamber 230, fluid enters lock port 238 to line 210 leading to bore 212, housing the lock pin 211. The fluid is of sufficient pressure and force to push the lock pin 211 against the biasing spring, causing the lock pin 211 to be in the unlocked position. Fluid does not vent from the bore 224 due to the position of spool land 209*c*. Spool land 209*c* contains a plug 221. Line 210 is connected to lock port 238 of the bore 224 by an annulus 223.

Some fluid from the second chamber 230 will enter the second advance line 240 connected to advance line 204 and some fluid from the advance chamber 202 may enter the second chamber through the second advance line 240. As shown in the Figure, land 209*c* partially blocks the second advance port 244 to the second advance line 240. The exchange of fluid is negligible.

FIG. 7*b* shows the oil pressure actuated phaser of the third embodiment in the retard position. For the retard position, the force of the biasing spring 225 is greater than the force of the VFS 220 (shown schematically) and the spool 209 is moved to the left in the drawings, causing the placement of the spool land 209*b* to block advance port 214 and the advance line 204. Spool land 209*c* blocks fluid from the second chamber 230 to second advance port 244 leading to second advance line 240 and lock port 238 leading to line 110 and lock pin 211. Since fluid from spool passage 219*b* cannot reach line 210, the force of the biasing spring locks the lock pin 211. Fluid from the lock pin bore 212 exits through lock port 238 and line 210 to the third chamber 232. Fluid in the third chamber 232 is exhausted through vent 222.

Hydraulic fluid enters the phaser from supply line 218 to line 216 and port 226. From port 226, fluid enters the first chamber 228. Since spool land 209*b* blocks advance port 214, fluid in the first chamber 228 may enter spool passage 219*a* as discussed above or retard port 215 to the retard line 205. Fluid in the retard line 205 enters the retard chamber 203 and moves the vane 201 in the direction indicated by the arrow. Fluid in the advance chamber 202 exits through advance line 204. Fluid is blocked by land 209*b* from passing through advance port 214 and instead fluid moves through connected second advance line 240 and second advance port 244 to the third chamber 232. Fluid from the third chamber 232 is exhausted through vent 222.

FIG. 7*c* shows the oil pressure actuated phaser of the third embodiment in the advance position. For the advance position, the force of the biasing spring 225 is less than the force of the VFS 220 (shown schematically) and the spool 209 is moved to the right in the drawing, causing the retard line 205 and retard port 215 to be open to vent.

Hydraulic fluid enters the phaser from supply line 218 to line 216 and port 226. From port 226, fluid enters the first chamber 228. The position of the spool 209, places the first chamber 228 in fluid communication with spool passage 219*a* and line 216, and advance line 204. Fluid from the first chamber 228 moves to spool passage 219*a* or through advance port 214 and advance line 204 to the advance chamber 202. The fluid in the advance chamber 202 moves the vane 201 in the direction indicated by the arrow. Fluid in the retard chamber exits through retard line 205 and retard port 215 to atmosphere or vent. Fluid that moved to the spool passage 119*a* in the first groove 234 between spool lands 209*a* and 209*b* enters spool passage 219*b*, which passes through spool land 209*b* entirely to the second chamber 230. From the second chamber 230, fluid enters lock port 238 to line 210 leading to bore 212 housing the lock pin 211. The fluid is of sufficient pressure and force to push the lock pin 211 against the biasing spring, causing the lock pin 211 to be in the unlocked position. Fluid does not vent from the bore 224 due to the position of spool land 209*c*. Spool land 209*c* contains a plug 221. Line 210 is connected to lock port 238 of the bore 224 by an annulus.

Some fluid in advance line 204 may enter the second advance line 240 and the second advance port 244 to the second chamber 230. From the second chamber 230 the fluid will enter lock port 238 and line 210 to the lock pin 211.

Figure 9A:
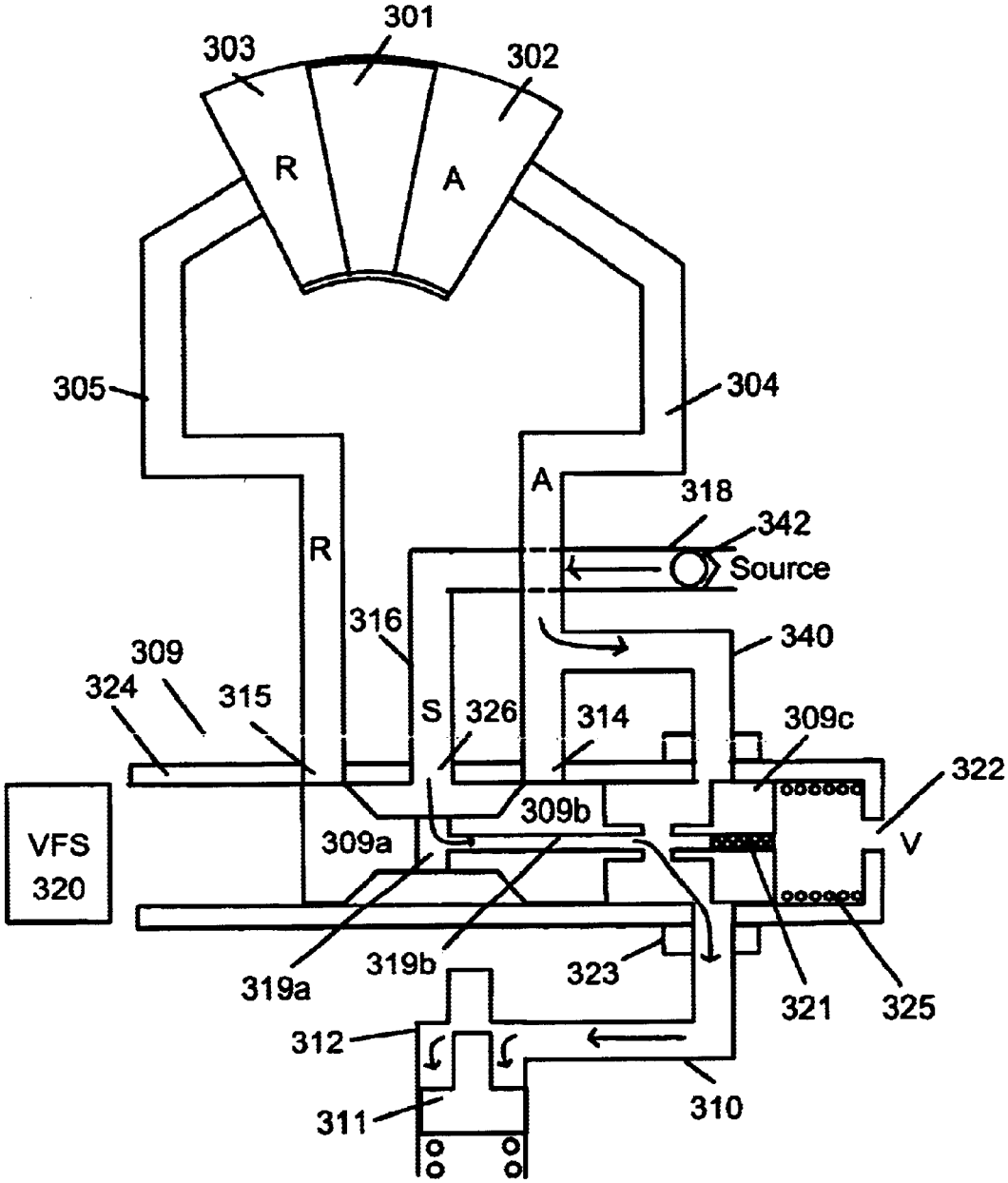
FIGS. 9*a*, 9*b*, and 9*c* show a fourth embodiment of the present invention in a single check valve torsion assist phaser.
Figure 9B:
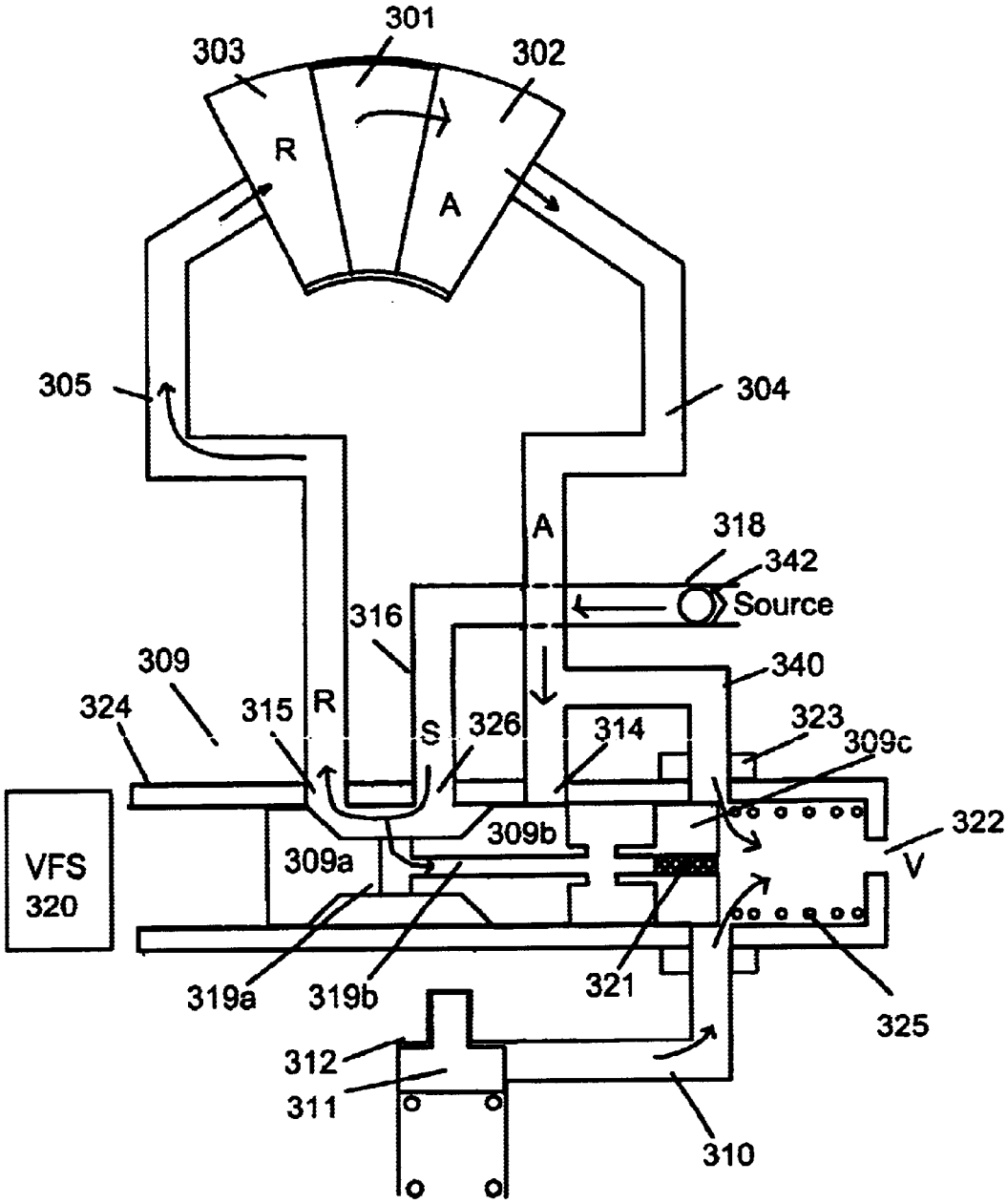
Figure 9C:
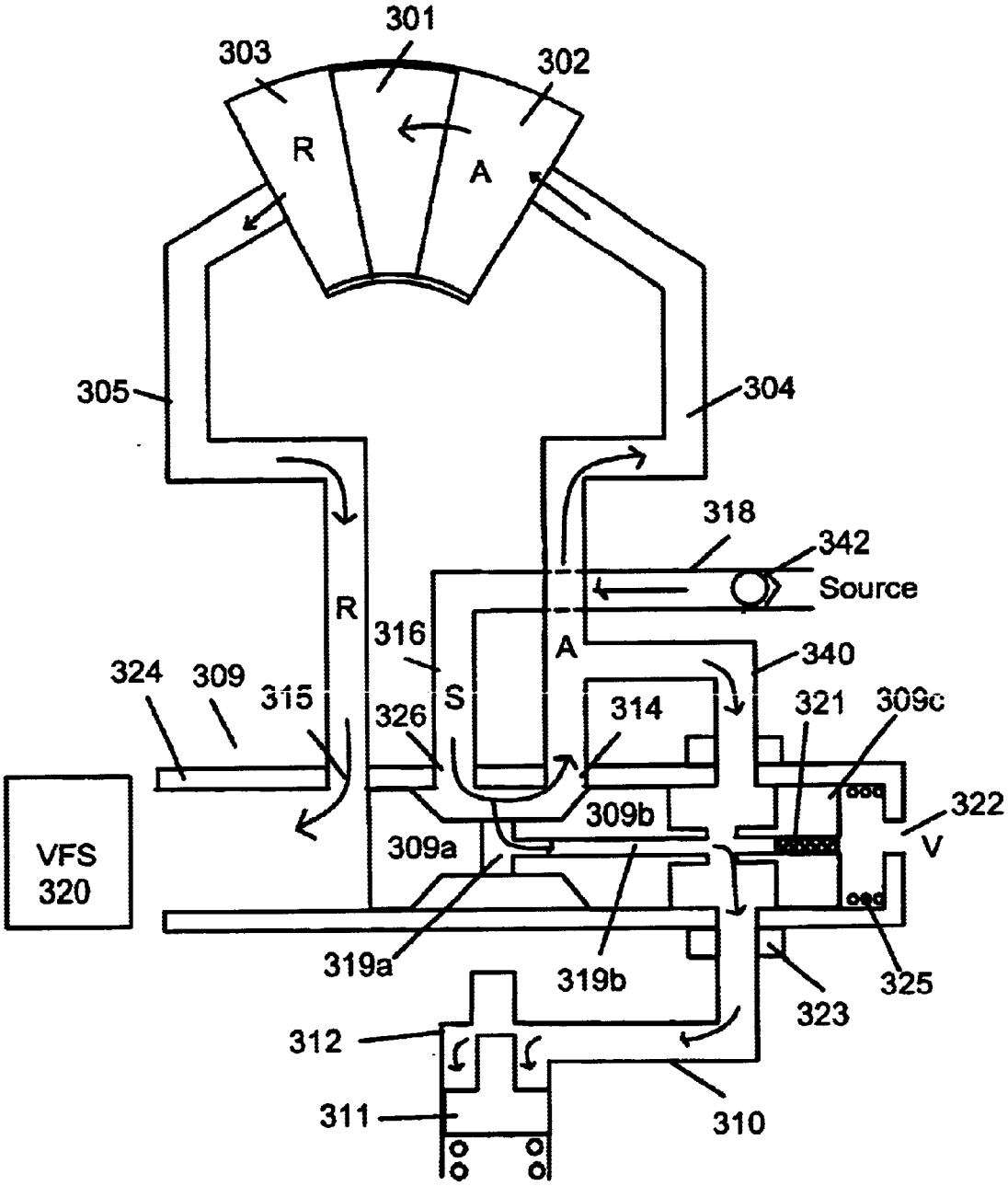
Figure 10:
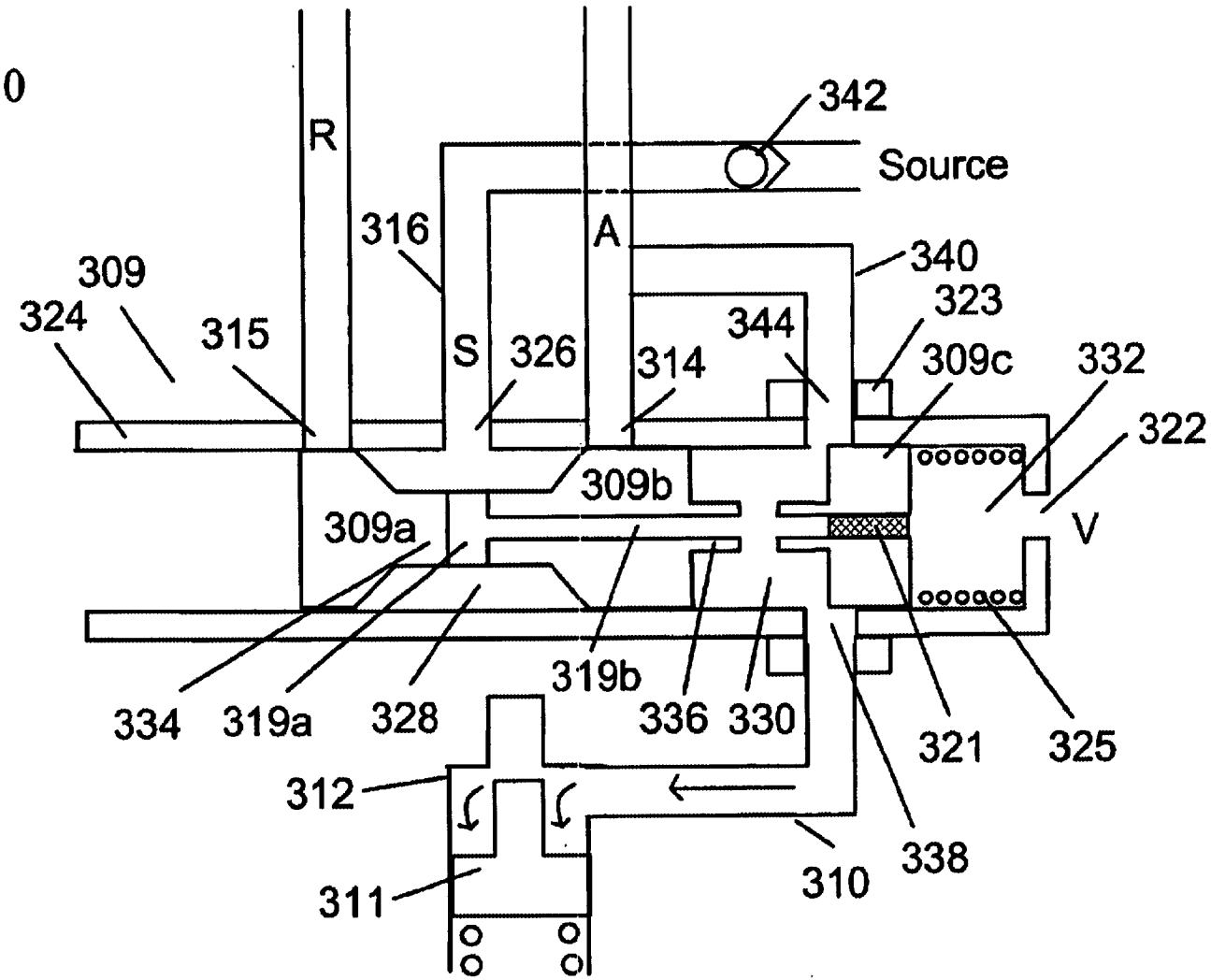
FIG. 10 shows a close-up of the axial cylindrical bore housing of the spool of FIG. 9*a*.

FIGS. 9*a* through 10 show schematics of the a fourth embodiment of the present invention in a single check valve torsion assist phaser. FIG. 9*a* shows the single check valve torsion assist phaser of the fourth embodiment in the null position. FIG. 9*b* shows the single check valve torsion assist phaser of the fourth embodiment in the retard position. FIG. 9*c* shows the single check valve torsion assist phaser of the fourth embodiment in the advance position. FIG. 10 shows a close-up of the spool in FIG. 7*a*.

Referring to FIGS. 9*a* and 10, hydraulic fluid enters the phaser through supply line 318 containing a check valve 342 to line 316 and port 326 of bore 324. The bore 324 has an open outer end, an inner surface, and an inner end having a vent port 322. The ports 314, 326, 315, 338, 344 to the advance line 304, line 316, the retard line 305, line 310 to the lock pin 311 within it's own bore 312 and second advance line 340 respectively, are all arranged along the bore 324. As shown in FIGS. 9*a* through 9*c*, and specifically FIG. 10, the ports are arranged from the open outer end to the inner end having a vent port 322, in the following order, advance port 314 in fluid communication with the advance chamber 302 via the advance line 304, port 326 in fluid communication with line 316, the retard port 315 in fluid communication with the retard chamber 303 via the retard line 305, the lock port 338 in fluid communication with lock pin 311 via line 310, and the second advance port 340 in fluid communication with the second advance line 340.

The bore 324 also houses the internally mounted spool 309, which receives spool lands 309*a*, 309*b*, and 309*c*, grooves 334, 336, and biasing spring 325. The spool 309, from an outer end to an inner end, the ends being defined in relation to the bore 325, comprises a first land 309*a*, a first groove 334, a second land 309*b*, a second groove 336, and a third land 309*c*. An inner surface of the bore 324 and the first groove 334 define a first chamber 328. Another part of the inner surface of the bore 324 and the second groove 336 define a second chamber 330. The inner end of the spool 309 and the bore 324 define a third chamber 332. A passage 319*a* is present in the first groove 334 and leads to another passage 319*b* in the second land 309*b* and groove 336, allowing fluid passage between the first chamber 328 and the second chamber 330.

Fluid from port 326, enters the first chamber 328 and spool passage 319*a*, when the phaser is in the null position, and lands 309*a* and 309*b* block ports 305, 304 and lines 315, 314, leading to the retard and advance chamber respectively, as shown in FIG. 9*a*. From spool passage 319*a*, in the first groove 334 between spool lands 309*a* and 309*b*, fluid enters spool passage 319*b*, which passes through spool land 309*b* entirely to the second chamber 330. From the second chamber 330, fluid enters lock port 338 to line 310 leading to bore 312 housing the lock pin 311. The fluid is of sufficient pressure and force to push the lock pin 311 against the biasing spring, causing the lock pin 311 to be in the unlocked position. Fluid does not vent from the bore 324 due to the position of spool land 309*c*. Spool land 309*c* contains a plug 321. Line 310 is connected to lock port 338 of the bore 324 by an annulus 323.

Some fluid from the second chamber 330 will enter the second advance line 340 connected to advance line 304 and some fluid from the advance chamber 302 may enter the second chamber through the second advance line 340. As shown in the Figure, land 309*c* partially blocks the second advance port 344 to the second advance line 340. The exchange of fluid is negligible.

FIG. 9*b* shows the single check valve torsion assist phaser of the fourth embodiment in the retard position. For the retard position, the force of the biasing spring 325 is greater than the force of the VFS 320 (shown schematically) and the spool 309 is moved to the left in the drawings, causing the placement of the spool land 309*b* to block advance port 314 and the advance line 304. Spool land 309*c* blocks fluid from the second chamber 330 to second advance port 344 leading to second advance line 340 and lock port 338 leading to line 310 and lock pin 311. Since fluid from spool passage 319*b* cannot reach line 310, the force of the biasing spring locks the lock pin 311. Fluid from the lock pin bore 312 exits through lock port 338 and line 310 to the third chamber 332. Fluid in the third chamber 332 is exhausted through vent 322.

Hydraulic fluid enters the phaser from supply line 318 containing a check valve 342 to line 316 and port 326. From port 326, fluid enters the first chamber 328. Since spool land 309*b* blocks port 314, fluid in the first chamber 328 may enter spool passage 319*a* as discussed above or retard port 315 to the retard line 305. Fluid in the retard line 305 enters the retard chamber 303 and moves the vane 301 in the direction indicated by the arrow. Fluid in the advance chamber 302 exits through advance line 304. Fluid is blocked by land 309*b* from passing through advance port 314 and instead fluid moves through connected second advance line 340 and second advance port 344 to the third chamber 332. Fluid from the third chamber 332 is exhausted through vent 322.

FIG. 9*c* shows the single check valve torsion assist phaser of the fourth embodiment in the advance position. For the advance position, the force of the biasing spring 325 is less than the force of the VFS 320 (shown schematically) and the spool 309 is moved to the right in the drawing, causing the retard line 305 and retard port 315 to be open to vent.

Hydraulic fluid enters the phaser from supply line 318 to line 316 and port 326. From port 326, fluid enters the first chamber 328. The position of the spool 309, places the first chamber 328 in fluid communication with spool passage 319*a* and line 316, and advance line 304. Fluid from the first chamber 328 moves to spool passage 319*a* or through advance port 314 and advance line 304 to the advance chamber 302. The fluid in the advance chamber 302 moves the vane 301 in the direction indicated by the arrow. Fluid in the retard chamber 303 exits through retard line 305 and retard port 315 to atmosphere or vent. Fluid that moved to the spool passage 319*a* in the first groove 334 between spool lands 309*a* and 309*b* enters spool passage 319*b*, which passes through spool land 309*b* entirely to the second chamber 330. From the second chamber 330, fluid enters lock port 338 to line 310 leading to bore 312 housing the lock pin 311. Fluid is of sufficient pressure and force to push the lock pin 311 against the biasing spring, causing the lock pin 311 to be in the unlocked position. Fluid does not vent from the bore 324 due to the position of spool land 309*c*. Spool land 309*c* contains a plug 321. Line 310 is connected to lock port 338 of the bore 324 by an annulus 423.

Some fluid in the advance line 304 may enter the second advance line 340 and the second advance port 344 to the second chamber 330. From the second chamber 330 the fluid will enter lock port 338 and line 310 to the lock pin 311.

Figure 11A:
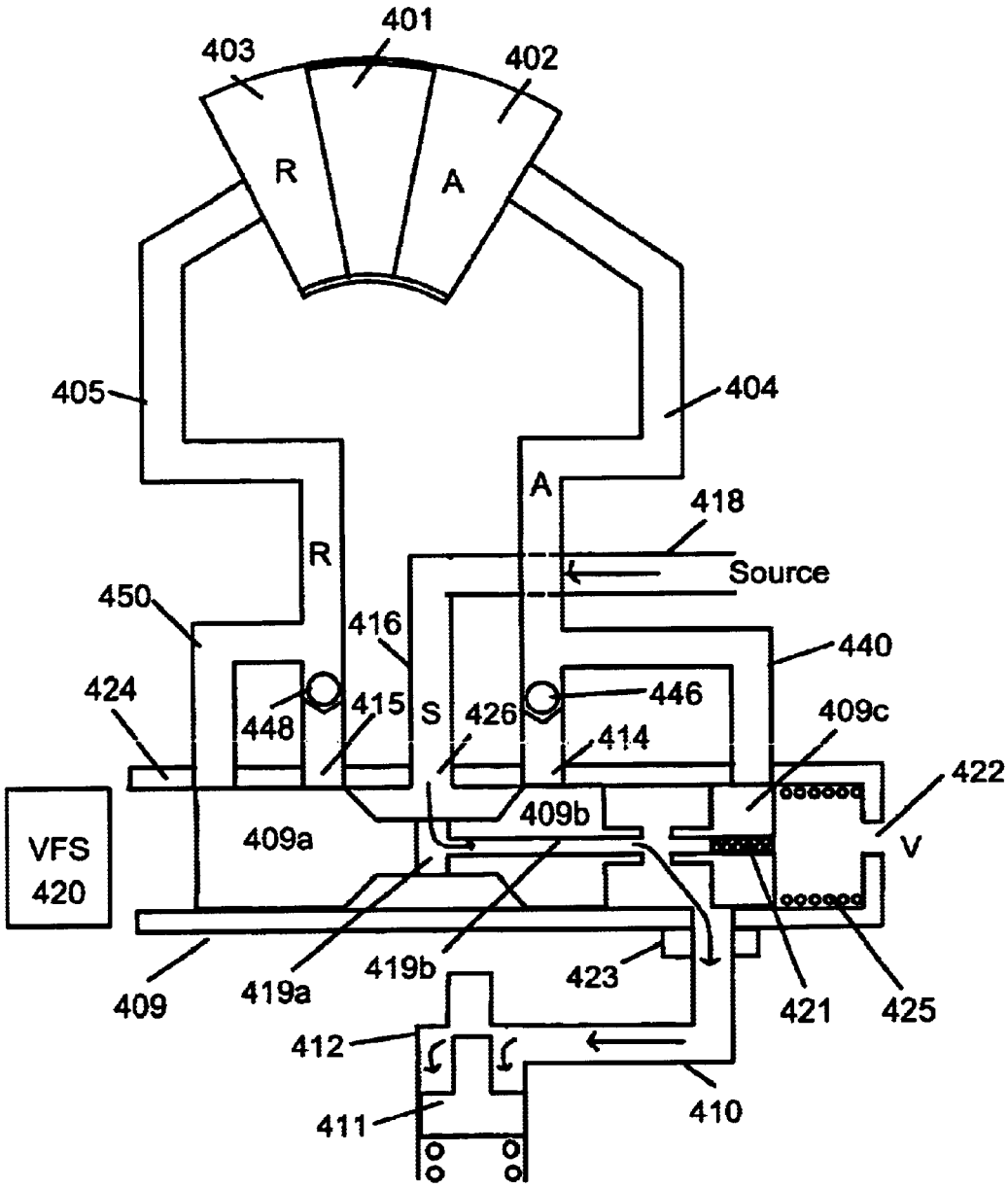
FIGS. 11*a*, 11*b*, and 11*c* show a fifth embodiment of the present invention in a dual check valve torsion assist phaser.
Figure 11B:
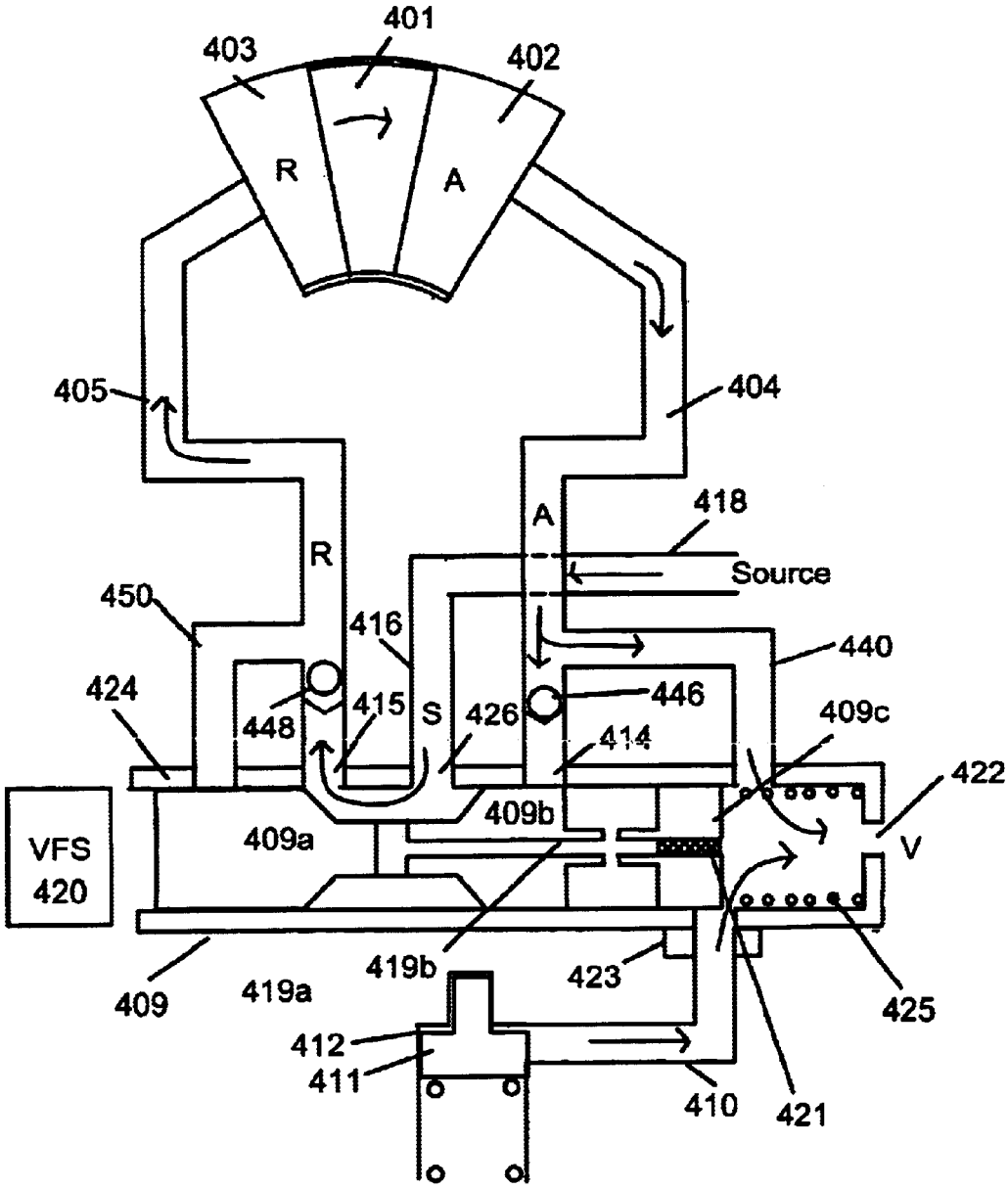
Figure 11C:
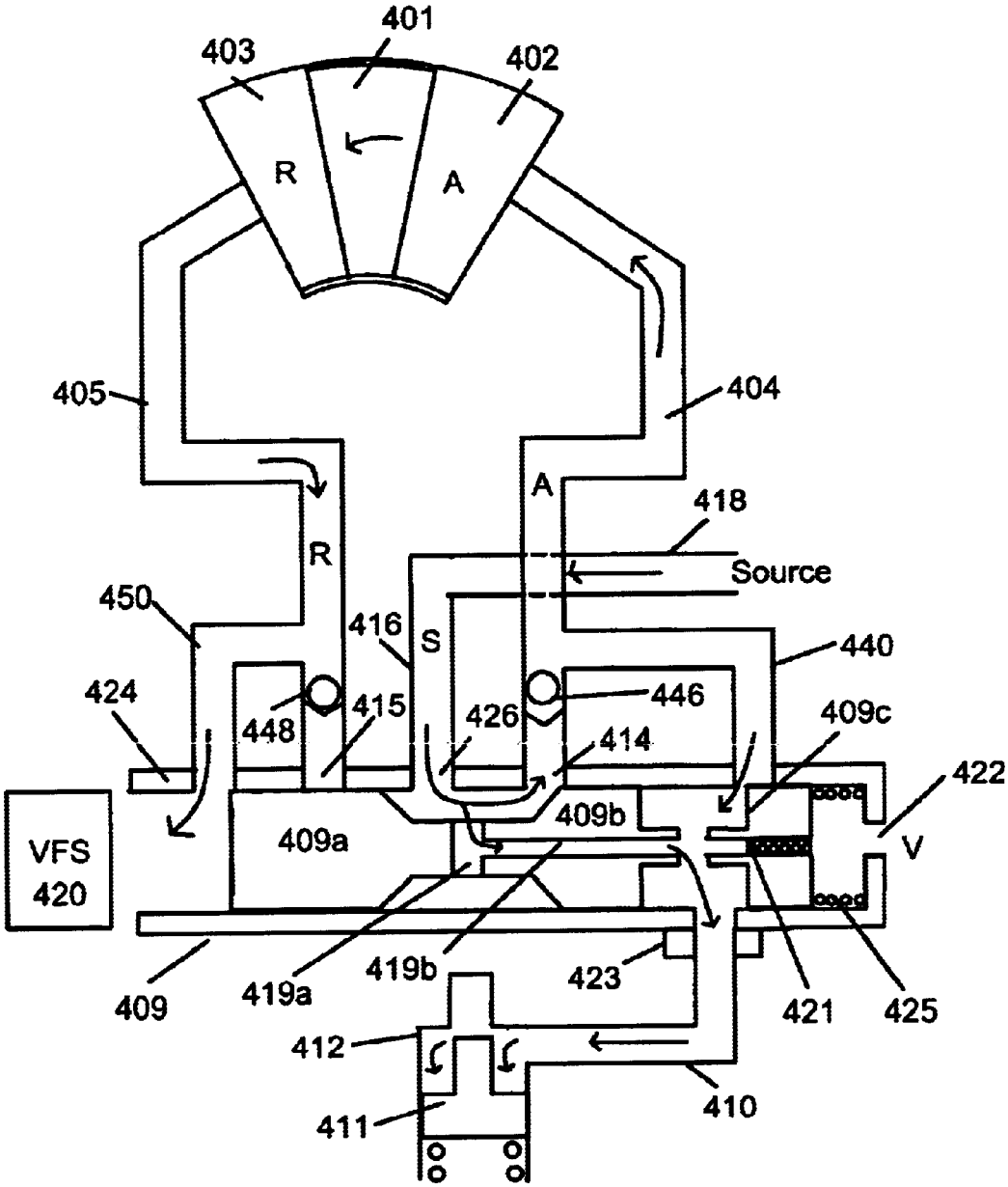
Figure 12:
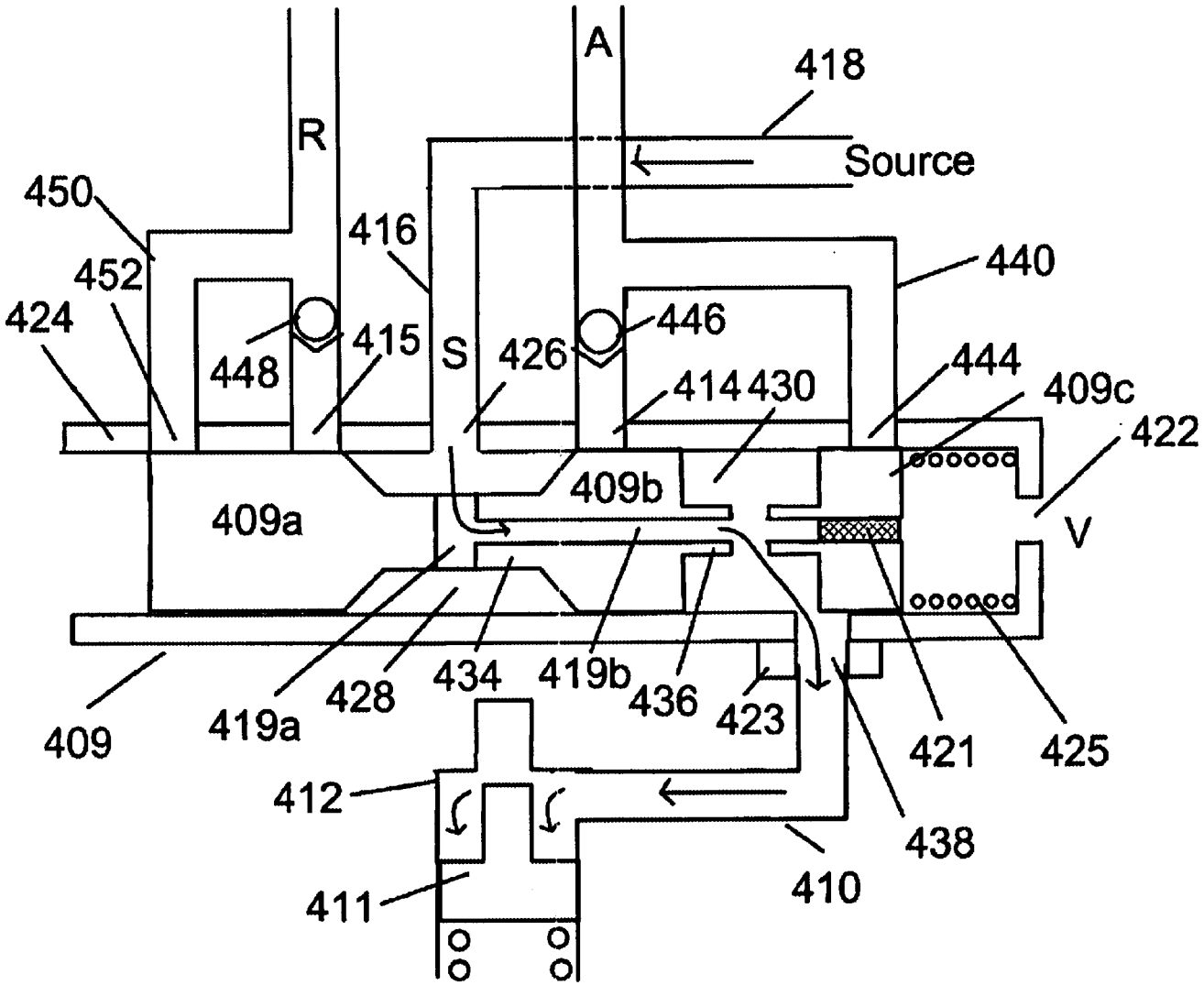
FIG. 12 shows a close-up of the axial cylindrical bore housing of the spool of FIG. 11*a*.

FIGS. 11*a* through 12 show schematics of the fifth embodiment of the present invention in a dual check valve torsion assist phaser. FIG. 11*a* shows the dual check valve torsion assist phaser of the fifth embodiment in the null position. FIG. 11*b* shows the dual check valve torsion assist phaser of the fifth embodiment in the retard position. FIG. 11*c* shows the dual check valve torsion assist phaser of the fifth embodiment in the advance position. FIG. 12 shows a close-up of the spool in FIG. 11*a*.

Referring to FIGS. 11*a* and 12, hydraulic fluid enters the phaser through supply line 418 to line 416 and port 426 of bore 424. The bore 424 has an open outer end, an inner surface, and an inner end having a vent port 422. The ports 452, 415, 426, 414, 444 to the second retard line 405 connected to the retard line above check valve 448, to the retard line 405 below check valve 448, to line 416, to the advance line 404 below the check valve 446, and to the second advance line 440 connected to the advance line 404 above the check valve 446 respectively, are all arranged along the bore 424. As shown in FIGS. 11*a* through 11*c*, and specifically FIG. 12, the ports are arranged from the open outer end to the inner end having a vent port 422, in the following order, a second retard port 452 in fluid communication with retard line 405, retard port 415 in fluid communication with the retard chamber 403 via the retard line 405, port 426 in fluid communication with line 416, advance port 414 in fluid communication with advance chamber 402 via the advance line 404, and a second advance port 444 in fluid communication with advance line 440.

The bore 424 also houses the internally mounted spool 409, which receives spool lands 409*a*, 409*b*, and 409*c*, grooves 434, 436, and biasing spring 425. The spool 409, from an outer end to an inner end, the ends being defined in relation to the bore 425, comprises a first land 409*a*, a first groove 434, a second land 409*b*, a second groove 436, and a third land 409*c*. An inner surface of the bore 424 and the first groove 434 define a first chamber 428. Another part of the inner surface of the bore 424 and the second groove 436 define a second chamber 430. The inner end of the spool 409 and the bore 424 define a third chamber 432. A passage 419*a* is present in the first groove 434 and leads to another passage 419*b* in the second land 409*b* and groove 436, allowing fluid passage between the first chamber 428 and the second chamber 430.

Fluid from port 426, enters the first chamber 428 and spool passage 419*a*, when the phaser is in the null position and lands 409*a*, 409*b* and 409*c* block ports 452, 415, 414, and 444, leading to the advance and retard chambers 402, 403 as shown in FIG. 9*a* are blocked. From spool passage 419*a*, in the first groove 434 between spool lands 409*a* and 409*b*, fluid enters spool passage 419*b*, which passes through spool land 409*b* entirely to the second chamber 430. From the second passage 430, fluid enters lock port 438 to line 410 leading to bore 412 housing the lock pin 411. The fluid is of sufficient pressure and force to push the lock pin 411 against the biasing spring, causing the lock pin 411 to be in the unlocked position. Fluid does not vent from bore 424 due to the position of spool land 409*a* and 409*c*. Spool land 409*c* contains plug 421. Line 410 is connected to lock port 438 of the bore 424 by an annulus 423.

FIG. 11*b* shows the dual check valve torsion assist phaser of the fourth embodiment in the retard position. For the retard position, the force of the biasing spring 425 is greater than the force of the VFS 420 (shown schematically) and the spool 409 is moved to the left in the drawings, causing the placement of spool land 409*a* to block the second retard port 452 and the second retard line 450 and spool land 409*b* to block advance port 414 and advance line 404. Spool land 409*c* blocks fluid from the second chamber 430 to the second advance port 444 leading to the second advance line 440 and lock port 438 leading to line 410 and lock pin 411. Since fluid form spool passage 419*b* cannot reach line 410, the force of the biasing spring locks the lock pin 411. Fluid form the lock pin bore 412 exits through lock port 438 and line 410 to the third chamber 432. Fluid in the third chamber 432 is exhausted through vent 422.

Hydraulic fluid enters the phaser from supply line 419 to line 416 and port 426. From port 426, fluid enters the first chamber 428. Since spool land 409*b* blocks advance port 414, fluid in the first chamber 428 may enter spool passage 419*a* as discussed above or retard port 415 through check valve 448 within the retard line 405. Fluid in the retard line 405 enters the retard chamber 403 and moves the vane 401 in the direction indicated by the arrow or may enter the second retard line 450. However, the second retard line 450 and second retard port 452 are blocked by spool land 409*a*. Fluid in the advance chamber 402 exits through advance line 404. Fluid is blocked by check valve 446 and land 409*b* from passing through advance port 414 and instead fluid moves through connected second advance line 440 and second advance port 444 to the third chamber 432. Fluid from the third chamber 432 is exhausted through vent 422.

FIG. 11*c* shows the dual check valve torsion assist phaser of the fifth embodiment in the advance position. For the advance position, the force of the biasing spring 425 is less than the force of the VFS 420 (shown schematically) and the spool 409 is moved to the right in the drawings, causing the placement of spool land 409*a* to block retard port 415 and retard line 405. Spool land 409*c* partially blocks the second advance port 444 and the second advance line 440. The second retard line 450 and the second retard port 452 are open to vent.

Hydraulic fluid enters the phaser from supply line 418 to line 416 and port 426. From port 426, fluid enters the first chamber 428. The position of the spool 409, places the first chamber 428 in fluid communication with spool passage 419*a*, line 416, and advance line 404. Fluid from the first chamber 428 moves to spool passage 419*a* or through advance port 414 through the check valve 446 in the advance line 404 to the advance chamber 402. The fluid in the advance chamber 402 moves the vane 401 in the direction indicated by the arrow. Fluid in the retard chamber 403 exits through retard line 405. Fluid is blocked by check valve 448 and land 409*a* from passing through retard port 415 and instead fluid moves through connected second retard line 450 and second retard port 452 and is exhausted from bore 424. Fluid that moved to the spool passage 419*a* in the first groove 434 between spool lands 409*a* and 409*b* enters spool passage 419*b*, which passes through spool land 409*b* entirely to the second chamber 430. From the second chamber 430, fluid enters lock port 438 to line 410 leading to bore 412 housing the lock pin 411. Fluid is of sufficient pressure and force to push the lock pin 411 against the biasing spring, causing the lock pin 411 to be in the unlocked position. Fluid does not vent from the bore 424 due to the position of spool land 409*c*. Spool land 409*c* contains a plug 421. Line 410 is connected to lock port 438 of the bore 424 by an annulus 423.

Some fluid in the advance line 404 may enter the second advance line 440 and the second advance port 444 to the second chamber 430. From the second chamber 430 the fluid will enter the lock port 438 and line 410 to the lock pin 411.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable cam timing phaser for an internal combustion engine with at least one camshaft comprising:

a housing having an outer circumference for accepting drive force;

a rotor for connection to a camshaft, coaxially located within the housing, the housing and the rotor defining at least one vane separating a chamber in the housing into an advance chamber and a retard chamber, the vane being capable of rotation to shift the relative angular position of the housing and the rotor; the rotor further having an axial cylindrical bore comprising an open outer end, an inner surface, and an inner end having a vent port, and arranged along the bore, an advance port in fluid communication with the advance chamber, a common port, a retard port in fluid communication with the retard chamber, and a lock port in fluid communications with a lock pin bore;

a spool valve comprising a spool slidably located within the bore in the rotor, the spool comprising, in order from an outer end to an inner end, a first land, a first groove, a second land, a second groove, and a third land; the area within the bore between the inner surface of the bore and the first groove defining a first chamber, the area between the inner surface of the bore and the second groove defining a second chamber and the area between the inner surface of the bore and the inner end of the spool defining a third chamber; the spool having a passage from the first groove to the second groove for fluid passage between the first chamber and the second chamber;

wherein when the spool is in an outermost position closest to the outer end of the bore, one of the retard port or the advance port is blocked by the second land, the first chamber is in communication with the other of the advance port or the retard port and the common port, and the lock port is in fluid communication with the third chamber and the vent port, such that the lock pin is in a locked position;

wherein when the spool is in a null position, the advance port and the retard port are blocked by the first land and the second land, and the lock port is in fluid communication with the second chamber, such that the lock pin is in an unlocked position; and wherein when the spool is in an innermost position closest to the inner end of the bore, one of the retard port or the advance port is blocked by the first land, the first chamber is in communication with the other of the advance port or the retard port and the common port, and the lock port is in fluid communication with the second chamber, such that the lock pin is in an unlocked position.

2. The phaser of claim 1, further comprising a common line in fluid communication with a source, the common port, an advance line and a retard line.

3. The phaser of claim 2, wherein the common line further comprises a line connecting the advance line and the retard line to the common line, the line further comprising check valves, wherein one of the check valves is in the line connecting the common line and the advance line and the other check valve is in the line connecting the common line and the retard line.

4. The phaser of claim 2, wherein fluid from the source moves through the common line and the check valve to advance line or through the common line and the check valve to the retard line, moving the vane and transfer fluid between the advance chamber or retard chamber to the other advance chamber or retard chamber.

5. The phaser of claim 1, further comprising a common line connected to a source line and the common port.

6. The phaser of claim 5, wherein fluid from the source line moves through the common line to the common port and from the common port the fluid moves to the advance chamber or the retard chamber.

7. The phaser of claim 5, further comprising a check valve in the source line.

8. The phaser of claim 1, further comprising a second advance line in fluid communication with an advance line having a second advance port between the advance port and the inner end of the axial cylindrical bore having a vent.

9. The phaser of claim 8, wherein when the spool is in the outermost position closest to the outer end of the bore, the second advance port is in fluid communication with the third chamber and the vent port.

10. The phaser of claim 8, wherein when the spool is in the null position, the second advance port is in fluid communication with the second chamber.

11. The phaser of claim 8, wherein when the spool is in the innermost position closest to the inner end of the bore, the second advance port is in fluid communication with the second chamber.

12. The phaser of claim 1, wherein the lock pin bore is connected to the lock port by an annulus.

13. The phaser of claim 1, further comprising a second advance line in fluid communication with an advance line having a second advance port between the advance port and the inner end of the axial cylindrical bore having a vent and a second retard line in fluid communication with a retard line having a second retard port between the open outer end the retard port.

14. The phaser of claim 13, further comprising a check valve in the advance line and another check valve in the retard line.

15. The phaser of claim 13, wherein when the spool is in the outermost position closest to the outer end of the bore, the second advance port is in fluid communication with the third chamber and the vent port and the second retard port is blocked by the first land of the spool.

16. The phaser of claim 13, wherein when the spool is in the null position, the second advance port is blocked by third land of the spool and the second retard port is blocked by the first land of the spool.

17. The phaser of claim 13, wherein when the spool is in the innermost position closest to the inner end of the bore, the second advance port is in fluid communication with the second chamber and the second retard port is exhausting to atmosphere.

* * * * *